US006681827B2

(12) United States Patent
Tamai et al.

(10) Patent No.: US 6,681,827 B2
(45) **Date of Patent: *Jan. 27, 2004**

(54) MARK TRANSFER TOOL AND MARK TRANSFER TAPE

(75) Inventors: Shigeru Tamai, Ikeda (JP); Masatoshi Shintani, Sanda (JP); Kouhei Koyama, Kyoto (JP)

(73) Assignee: Seed Company Limited, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/062,553

(22) Filed: Feb. 5, 2002

(65) Prior Publication Data

US 2002/0170682 A1 Nov. 21, 2002

(30) Foreign Application Priority Data

May 21, 2001 (JP) ..... 2001-150401

(51) Int. Cl.[7] ..... B32B 31/00

(52) U.S. Cl. ..... 156/577; 156/579; 118/76; 242/160.4; 242/171; 242/588.6; 206/411; 428/42.3

(58) Field of Search ..... 156/523, 527, 156/538, 540, 574, 577, 579; 118/76, 200, 257; 225/46; 242/160.2, 160.4, 170, 171, 588, 588.2, 588.3, 588.6; 428/42.3

(56) References Cited

U.S. PATENT DOCUMENTS 4,525,237 A * 6/1985 Clar ..... 156/540
4,718,971 A * 1/1988 Summers ..... 156/540
4,880,490 A * 11/1989 MacIntyre ..... 156/541
5,824,379 A * 10/1998 Riley et al. ..... 428/40.1
6,029,849 A * 2/2000 Meshulam ..... 221/26
6,145,770 A * 11/2000 Manusch et al. ..... 156/577 X
6,177,163 B1 * 1/2001 Blok et al. ..... 428/40.1
6,394,165 B1 * 5/2002 Rader ..... 156/540
2002/0179242 A1 * 12/2002 Wien ..... 156/344

OTHER PUBLICATIONS

IBM Technical Disclosure Bulletin, vol. 18, No. 7, Label Attachment Machine, Pierson, Dec. 1975.*

* cited by examiner

*Primary Examiner*—Mark A. Osele
(74) *Attorney, Agent, or Firm*—Rader, Fishman & Grauer PLLC

(57) ABSTRACT

A mark transfer tool making use of a coat film transfer technology about various marks composed of characters, codes, patterns or their combination. A mark transfer tape is composed of pressure-sensitive adhesive transfer marks disposed and held on the surface of a base tape continuously and peelably at specific intervals, and each mark is composed of a mark and an overwriting blank space. A visual recognition line for showing the division position of transfer marks is disposed between the transfer marks, and the leading edge of the transfer head is a visual recognition positioning part, and the coincidence of the two is recognized as the standard for transfer, so that the transfer mark of the mark transfer tape can be accurately transferred on a transfer area.

40 Claims, 21 Drawing Sheets

MARK TRANSFER TOOL AND MARK TRANSFER TAPE

BACKGROUND OF THE INVENTION

1. Field of the Invention

The present invention relates to a mark transfer tool and a mark transfer tape, and more particularly to a mark transfer technology for transferring a transfer mark in a thin film composed of characters, codes, patterns or their combination arranged and formed on a mark transfer tape, to a sheet of paper or the like.

2. Description of the Related Art

Generally, various marks composed of characters, codes, patterns or their combination are prepared as stamps and impressed on a sheet of paper or other object surface through ink, or prepared as mark seals and adhered to a sheet of paper or the like.

In the background of the recent technical innovation and diversification of users' preferences, widening of product variety is needed in various technical fields, and such trend is not exceptional in the stationery field handling various marks.

BRIEF SUMMARY OF THE INVENTION

It is hence a primary object of the invention to present a novel mark transfer tool and mark transfer tape solving the problems of the prior art.

It is other object of the invention to present a novel mark transfer technology completely different from the conventional mark using technology, about various marks composed of characters, codes, patterns or their combination, by making use of coat film transfer technology.

It is another object of the invention to present a mark transfer tool effectively applicable to diversified preferences of general users, by employing a method of transferring a transfer mark on a mark transfer tape on a sheet of paper or the like.

It is a further object of the invention to present a mark transfer tool using the transfer mark composed of various marks and blank spaces for overwriting, in which various characters can be written over by a writing tool in the blank spaces for overwriting after transfer of transfer marks.

The mark transfer tool of the invention is a tool for transferring a transfer mark on a mark transfer tape on a sheet of paper or the like, comprising a hand-held case, a pay-out reel containing a mark transfer tape, being rotatably installed in the case, a rotatable take-up reel for collecting the used mark transfer tape, being rotatably installed in the case, and a transfer head for pressing and transferring the mark transfer tape being paid out from the pay-out reel onto the transfer area, being disposed at the leading end of the case, in which the mark transfer tape has pressure-sensitive adhesive transfer marks disposed and held continuously at specific intervals peelably on the surface of a base tape, the transfer marks are composed of various marks and overwriting blank spaces, division visual recognition means showing division positions of transfer marks is disposed between transfer marks, and visual recognition positioning parts visually corresponding and coinciding with the division visual recognition means of the mark transfer tape are disposed at visually recognizable positions at the stationary side of the traveling mark transfer tape.

In a preferred embodiment, at least the surface forming portion of the overwriting blank spaces is made of a material to be written by a writing tool.

Further, the visual recognition positioning parts are disposed at visually recognizable positions of the tape running area of the transfer head, or at visually recognizable positions in the leading end portion of the case. For example, in the former transfer head, the leading end edge of the transfer head or the positioning index provided on the surface of the transfer head is preferably employed, or in the latter case, the leading end edge of the projecting position of the transfer head in the case is preferably employed.

Further, as the visual recognition positioning parts, the leading end edge of the transfer head or the positioning index provided on the surface of the transfer head is employed.

As the division visual recognition means, for example, the following modes may be employed.

(1) The division visual recognition means is a line for visual recognition extending straightly in the width direction of the base tape formed between mutually adjacent transfer marks in the base tape, and is composed to indicate the transfer completion position of one transfer mark when the visual recognition line corresponds and coincides with the visual recognition position part in the mark transfer operation.

(2) The division visual recognition means is a mark indication line for indicating the transfer length range of each transfer mark provided at least at one edge in the width direction of the base tape, and the boundary between mutually adjacent mark indication lines is the division visual recognition part, and is composed to indicate the transfer completion position of one transfer mark when the visual recognition line corresponds and coincides with the visual recognition position part in the mark transfer operation.

(3) The division visual recognition means is a notch for visual recognition penetrating through mutually adjacent transfer marks in the base tape, and is composed to indicate the transfer completion position of one transfer mark when the visual recognition notch corresponds and coincides with the visual recognition position part in the mark transfer operation.

Further, depending on the purpose, the division allowable visual recognition part is provided at least at the upstream side or downstream side in the tape running direction of the division visual recognition means, and it is composed to indicate the allowable limit of the transfer completion position or transfer start position of one transfer mark when the division allowable visual recognition part corresponds and coincides with the visual recognition position part in the mark transfer operation.

The basic composition of operation of the mark transfer tool is either a tape refill type having a tape cartridge comprising at least the pay-out reel and take-up reel detachably disposed in the case so that the mark transfer tape may be exchanged, or a one time type having the pay-out reel and take-up reel disposed in the case, with the transfer head provided at the leading end of the case.

The mark transfer tape of the invention is preferably disposed and used in the mark transfer tool, in which pressure-sensitive adhesive transfer marks are disposed and held continuously at specific intervals peelably on the surface of a base tape, the transfer marks are composed of various marks and overwriting blank spaces, division visual recognition means showing division positions of transfer marks is disposed between transfer marks, and the division visual recognition means is configured to indicate the division position of one transfer mark when visually corresponding and coinciding with the visual recognition positioning part provided on the transfer head of the mark transfer tool in the mark transfer operation of the mark transfer tool.

In a preferred embodiment, at least the surface forming portion of the overwriting blank spaces is made of a material to be written by a writing tool.

Further, the mark transfer tape of the invention is composed of a transfer mark layer comprising multiple transfer marks adhered and held to the surface side of the base tape of which back side is processed to be peelable, peelably or peelably and separably in pieces, and more specifically the following lamination structure is employed.

i) The transfer mark layer is composed by integrally laminating a pressure-sensitive adhesive layer composed of a pressure-sensitive adhesive transparent material, and a mark array layer composed of multiple marks arranged continuously at specific intervals in the running direction of the base tape, and this transfer mark layer is adhered and held to the surface of the base tape processed to be peelable, peelably and separably in pieces through the pressure-sensitive adhesive layer.

ii) The transfer mark layer is composed by integrally laminating a mark forming layer composed of an adhesive transparent material, a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be peelable, peelably and separably in pieces through the mark forming layer.

iii) The transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be peelable, peelably and separably in pieces through the mark array layer.

iv) The transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be adhesive, peelably and separably in pieces through the mark array layer.

Further, as the division visual recognition means, the following modes may be employed.

(a) The division visual recognition means is a line for visual recognition formed correspondingly between mutually adjacent transfer marks on the surface of the base tape, and is composed to indicate the transfer completion position of one transfer mark when the visual recognition line corresponds and coincides with the visual recognition position part in the mark transfer operation of the mark transfer tool.

(b) The division visual recognition means is composed of a mark indication formed at least at one edge in the width direction on the surface of the base tape, and a division visual recognition part as the boundary between mutually adjacent mark indication lines, and the mark indication line is disposed corresponding to the transfer length range of the transfer mark, and is composed to indicate the transfer completion position of one transfer mark when the visual recognition line corresponds and coincides with the visual recognition position part in the mark transfer operation of the mark transfer tool.

(c) The base tape is made of a see-through transparent film material, and the division visual recognition means is a line for visual recognition formed correspondingly between mutually adjacent transfer marks on the back side of the base tape, and is composed to indicate the transfer completion position of one transfer mark when the visual recognition line corresponds and coincides with the visual recognition position part in the mark transfer operation of the mark transfer tool.

(d) The base tape is made of a see-through transparent film material, and the division visual recognition means is composed of a mark indication formed at least at one edge in the width direction on the back side of the base tape, and a division visual recognition part as the boundary between mutually adjacent mark indication lines, and the mark indication line is disposed corresponding to the transfer length range of the transfer mark, and is composed to indicate the transfer completion position of one transfer mark when the division visual recognition part corresponds and coincides with the visual recognition position part in the mark transfer operation of the mark transfer tool.

(e) The division visual recognition means is a notch for visual recognition penetrating through mutually adjacent transfer marks at least in the base tape, and is composed to indicate the transfer completion position of one transfer mark when the visual recognition notch corresponds and coincides with the visual recognition position part in the mark transfer operation of the mark transfer tool.

Further, depending on the purpose, the division allowable visual recognition part is provided at least at the upstream side or downstream side in the tape running direction of the division visual recognition means, and it is composed to indicate the allowable limit of the transfer completion position or transfer start position of one transfer mark when the division allowable visual recognition part corresponds and coincides with the visual recognition position part in the mark transfer operation of the mark transfer tool.

To transfer the transfer mark on the mark transfer tape on a desired transfer area of a sheet of paper, the case is held by fingers, the leading end pressing portion of the transfer head is pressed tightly to the transfer area, and the case is moved along the sheet of paper in this state, so that the transfer mark is transferred.

Specifically, with the division visual recognition means provided in the mark transfer tape visually coinciding with the visual recognition positioning part of the transfer head, the transfer head is tightly pressed to the transfer start end on the transfer area, and the case is directly moved along the sheet of paper, and is stopped when the next division visual recognition means visually coincides with the visual recognition positioning part.

By this operation, the transfer mark on the mark transfer tape at the leading end pressing portion of the transfer head is peeled off the base tape, and is accurately transferred on the transfer area, and the used mark transfer tape after the transfer mark is separated, that is, the base tape is taken up and collected on the take-up reel.

Further, after transfer, it is allowed to write over by a writing tool in the over writing blank space of the transfer mark.

DETAILED DESCRIPTION OF THE PREFERRED EMBODIMENTS

Figure 1:
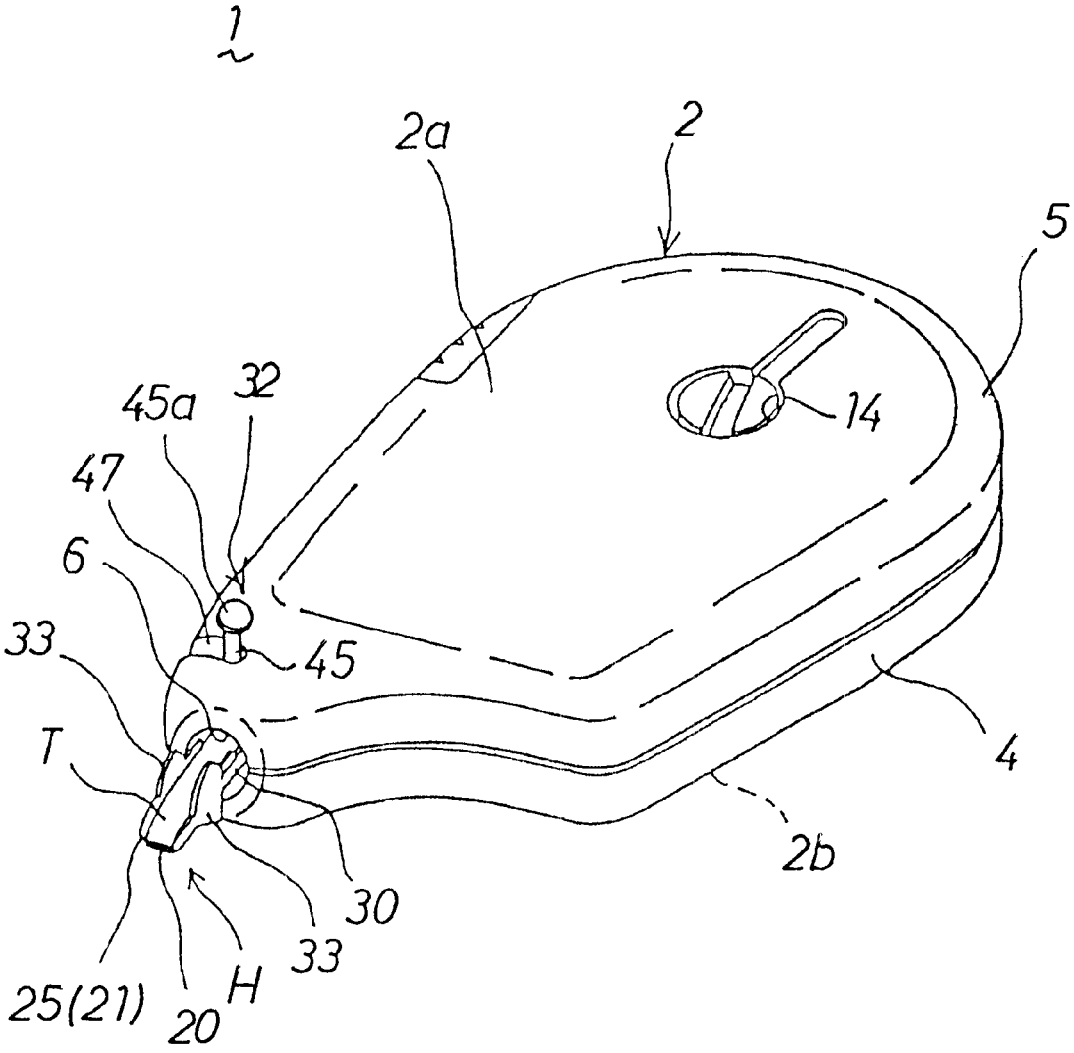
FIG. 1 is a perspective view showing a mark transfer tool in embodiment 1 of the invention.

Referring now to the drawings, preferred embodiments of the invention are described in detail below.

FIG. 1 through FIGS. 21A–21C show the mark transfer tool according to the invention, and same reference numerals indicate same constituent members or elements throughout the entire drawings.

Embodiment 1

The mark transfer tool according to this embodiment is shown in FIG. 1 to FIGS. 8A–8C. This mark transfer tool 1 is, specifically, to transfer marks M, M, . . . in a thin film on a mark transfer tape T, and it is a tape refill type having a cartridge structure allowing to exchange the mark transfer tape T as a consumable part.

Figure 2:
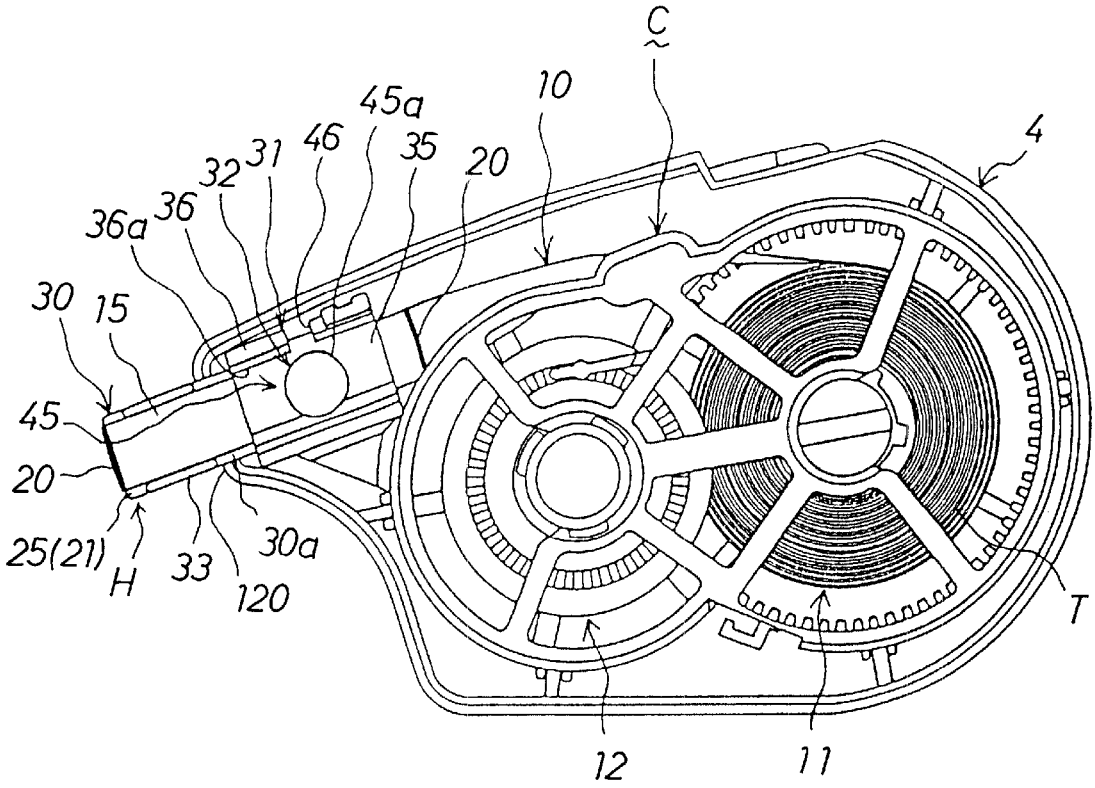
FIG. 2 is a front view showing the inside of a case main body of the mark transfer tool.
Figure 3:
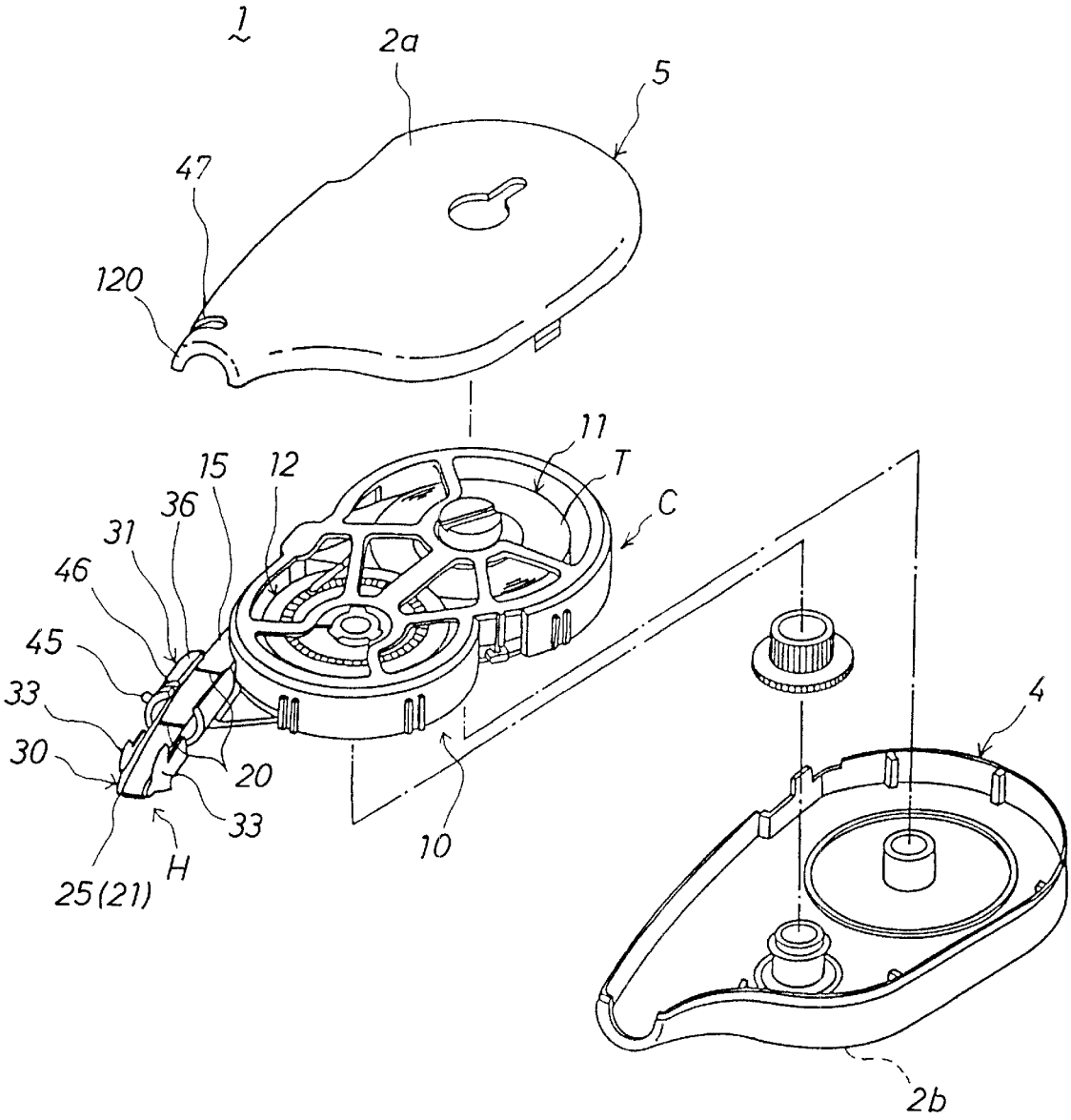
FIG. 3 is a perspective exploded view of the mark transfer tool.

That is, the mark transfer tool 1 comprises a case 2 having an appearance as shown in FIG. 1, and a tape cartridge C having a transfer head H as shown in FIG. 2 and FIG. 3.

The transfer mark M is composed of a mark Ma of arranged characters, codes, patterns or their combination, and an over writing blank space Mb allowing to be written over by a writing tool. More specifically, as shown in FIG. 4B, the mark Ma is a designed alphabetical letter FAXED, and the overwriting blank space Mb is a blank space matched in shape with the FAXED mark Ma (inside of a nearly elliptical frame), and the date is entered in this overwriting blank space Mb.

The case 2 is held and manipulated by one hand, and is a flat box having a front contour shape and dimension and width enough to incorporate the tape cartridge C, and its confronting pair of flat face and back sides 2*a,* 2*b* are standard gripping sides when holding and manipulating by one hand. The case 2 is a plastic structure integrally formed by injection molding or the like, and a case main body 4 and a cap body 5 are separate, and the tape cartridge is detachably inserted in the case main body 4. At the leading end of the case 2, ahead inserting portion 6 for inserting the transfer head H in and out is formed.

The tape cartridge C is an exchangeable consumable part. The tape cartridge C consists of a pay-out reel 11 on which a mark transfer tape T is wound, and a rotatable take-up reel 12 for collecting the mark transfer tape T after use, which are rotatably installed in a cartridge case 10, and further a transfer head H for pressing and transferring the mark transfer tape T to the transfer area is installed rotatably about the head axial center.

Although not specifically shown in the drawing, the tape cartridge C further includes a tape interlocking unit for mutually interlocking the pay-out reel 11 and take-up reel 12, a clutch mechanism for synchronizing the pay-out speed and take-up speed of the mark transfer tape T in the pay-out reel 11 and take-up reel 12, and other principal and basic components, which are assembled as a unit.

The cartridge case 10 is made of synthetic resin in a form of a cartridge case for accommodating the both reels 11, 12, and its shape and dimensions are set to be light weight and compact in a range of having holding functions of both reels 11, 12, and more specifically it is a skeletal structure mainly composed of thin skeletal members.

The mark transfer tape T is to supply transfer marks M continuously, and pressure-sensitive adhesive transfer marks M are disposed and held on the surface of a base tape 15 continuously and peelably at specified intervals. Between the transfer marks M, M, division visual recognition means 20 showing the division position of transfer marks M is disposed, and corresponding to this, at the visually recognizable position at the stationary side to the traveling mark transfer tape T (in the shown example, the visually recognizable position of the tape traveling part of the transfer head H), a visual recognition positioning part 21 visually corresponding and coinciding with the division visual recognition means 20 is provided.

Figure 5A:
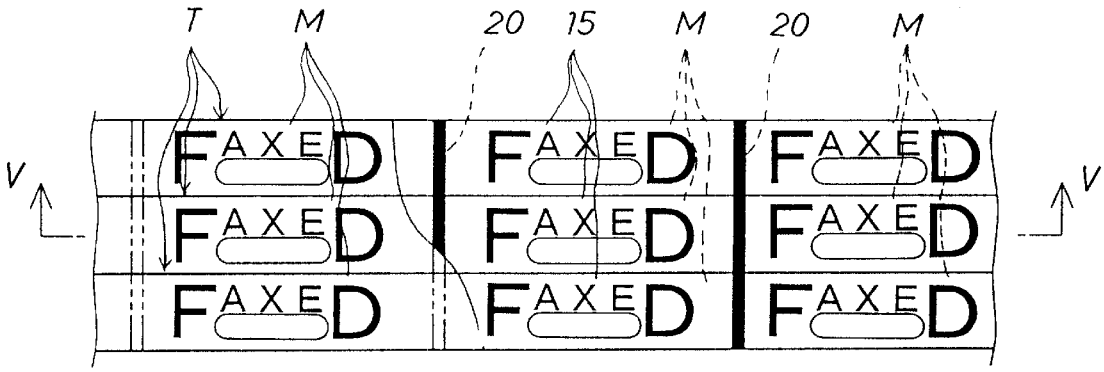
FIG. 5A is a plan of mark transfer tool of the mark transfer tool, showing a partially cut-away view of the mark transfer tape in the manufacturing process.
Figure 5B:
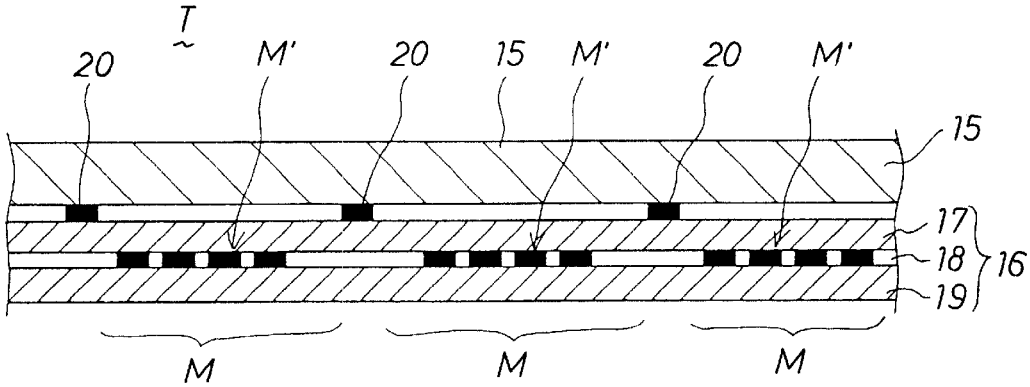
FIG. 5B is a sectional view along line V—V in FIG. 5A of the mark transfer tape.
Figure 5C:
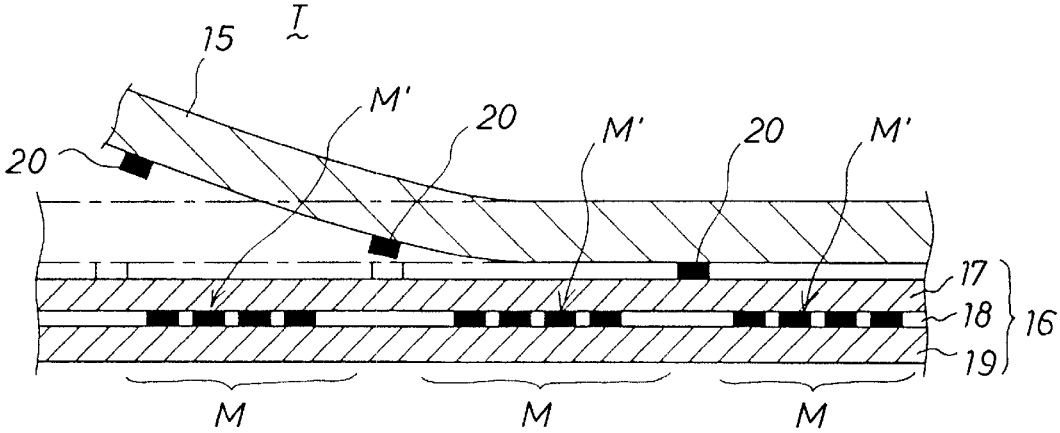
FIG. 5C is a sectional view showing a peeling state of base tape and transfer mark layer of the mark transfer tape.

In the shown embodiment, the mark transfer tape T has a sectional structure as shown in FIG. 5, and on the surface of the base tape 15 (the lower side in FIG. 5B and FIG. 5C), a transfer mark layer 16 composed of multiple transfer marks M, M, . . . is peelably adhered and held. Since the drawings are intended to help understanding, they are schematic and magnified in the thickness direction, but actually the mark transfer tape T is a thin film, and the boundary of layers is not so clear as illustrated.

The base tape 15 has its both face and back sides processed to be peelable, that is, it is a film tape made of plastic or paper material, having the surface treated to be separable or peelable from the adjacent layers or materials, and a non-stretchable flexible film is preferably used.

The transfer mark layer 16 is a laminate structure integrally laminating a mark forming layer 17, a mark array layer 18, and a pressure-sensitive adhesive layer 19. This transfer mark layer 16 is continuous over the overall length of the base tape 15, that is, the transfer marks M, M, . . . are formed continuously, and are properly cut off by transfer operation of the transfer head H at the time of mark transfer.

Quality requirements of the transfer mark layer 16, for example, include the following.

1) Transferring property: Ease of transfer of position of transfer mark layer 16 pressed by the transfer head H on the transfer area.

2) Cutting performance: Ease of transfer and cutting of only the position of the transfer mark layer 16 pressed by the transfer head H (if the cutting performance of the transfer mark layer 16 is poor, the portion of the transfer mark layer 16 not intended to be transferred may be transferred).

3) Peeling resistance: Strength of sticking of transfer mark layer 16 to transfer area.

4) Writing performance: Ease of writing by pencil, ball-point pen or other writing tool on the transferred transfer mark layer 16.

5) Aging stability: Freedom from discoloration or blurring of ink written by writing tool on the transferred transfer mark layer 16.

6) Smoothness: Smoothness of surface of transfer mark layer 16 after transfer.

Various compounds are combined in order to prove the transfer mark layer 16 with these quality characteristics depending on the purpose.

The mark forming layer 17 is intended to facilitate formation (specifically printing) of mark array layer 18, and has a function of adhering and holding the transfer mark layer 16 on the surface of the base tape 15, and a surface layer is formed after transfer of transfer mark M. The mark forming layer 17, in addition to these basic functions (forming function of mark array layer 18 and adhering and holding function of transfer mark layer 16), also has an overwriting function by a writing tool 130 (see FIG. 8A) such as ball-point pen on the overwriting blank space Mb, as the surface forming area of the transfer mark layer 16 after transfer of the transfer mark M.

For this purpose, the mark forming layer 17 is made of an adhesive transparent material for expressing these functions. That is, the mark forming layer 17 is preferably made of a transparent resin material of dry type suited to surface layer after parting, having a proper adhesion holding property on the parted surface of the base tape 15, and also allowing overwriting by a writing tool 60.

The mark forming layer 17 is made of synthetic resin or natural resin, and other additives may be used, such as surface active agent, aging retarder, light fastness stabilizer, or filler for improving the writing performance.

Examples of synthetic resin and natural resin include acrylic resin, vinyl resin, polyester resin, urethane resin, epoxy resin, polyamide resin, olefin resin, rubber, styrene-butadiene copolymer, cellulose resin, and coumarone, and these resins are used either alone or in combination of two or more types in order to satisfy these quality requirements.

The mark array layer 18 is composed of multiple marks (in the shown example, mark Ma of designed alphabetical letter FAXED, and overwriting blank space Mb of a blank space matched in shape with this mark Ma) M', M', M', . . . arranged continuously and peelable at specific intervals in the running direction of the base tape 15, and is specifically formed on the mark forming layer 17 by a known printing technology.

The printing method of the mark array layer 18 includes various known printing techniques, specifically, traditional printing techniques such as typographic (relief) printing, offset printing, gravure (intaglio) printing, silk screen printing or tampon printing, and reverse roll coating, direct coating and other coater methods, spray coating, electrostatic coating, flow coating, roller coating, immersion coating, and further novel printing techniques such as laser printer, heat transfer, and ink jet printer systems, which may be properly selected depending on the properties of the forming object area (in the shown case, the mark forming layer 17).

The pressure-sensitive adhesive layer 19 is used to press and adhere the transfer mark layer 16 to the transfer area, and to form a surface layer of mark transfer tape T before transfer, and this pressure-sensitive adhesive layer 19 is made of a pressure-sensitive transparent material. That is, the pressure-sensitive adhesive layer 19 is preferably made of a transparent see-through adhesive material of dry type suited to a surface layer before parting, having a pressure-sensitive adhesion to the transfer area.

The pressure-sensitive adhesive layer 19 is made of ad adhesive component, and further adhesion regulator, aging retarder, or leveling agent may be blended. Examples of adhesive include acrylic resin, rosin, rubber, vinyl ether, polyurethane, styrene, and polyisobutylene.

Such laminated transfer mark layer 16 is, as shown in FIG. 5, adhered and held on the surface (the lower side in FIG. 5B and FIG. 5C) of the base tape 15 processed for parting, peelably and separably through the mark forming layer 17.

The division visual recognition means 20 is specifically, as shown in FIGS. 5A–5C, a line for visual recognition printed and formed on the surface (the lower side in FIG. 5B and FIG. 5C) of the base tape 15, and its printing method is one of various conventional printing techniques same as in the case of the mark array layer 18.

This visual recognition line 20 is extended linearly in the width direction of the base tape 15 between the transfer marks M, M of the transfer mark layer 16, and is formed, for example, by known printing process on the surface of the base tape 15. Since the visual recognition line 20 is made of a transparent adhesive material so that the mark forming layer 17 and pressure-sensitive adhesive layer 19 of the transfer mark layer 16 can be seen through, so that it is visible from the surface side of the base tape 15, whether the transfer mark layer 16 is present or not on the base tape 15.

The specific forming position of the visual recognition line 20 is set corresponding to the visual recognition positioning part 21 of the transfer head H, and is set so as to indicate the division position of one transfer mark M, or the transfer completion position in the shown embodiment, when the visual recognition line 20 visually coincides with the visual recognition positioning part 21 in the mark transfer operation of the mark transfer tool 1 mentioned below.

The visual recognition positioning part 21 corresponding to the visual recognition line 20 is set at s position capable of visually recognizing the tape traveling part of the transfer head H, and in the shown embodiment, the leading edge of the transfer head H, that is, the leading end pressing portion 25 functions also as the visual recognition positioning part 21.

Figure 4A:
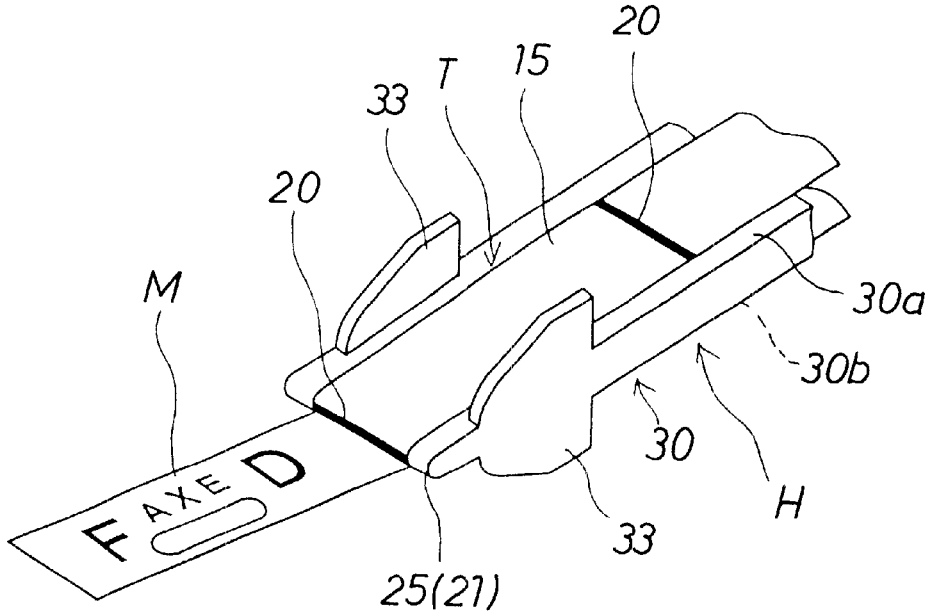
FIG. 4A is a perspective view showing essential parts of transfer head of the mark transfer tool.
Figure 4B:
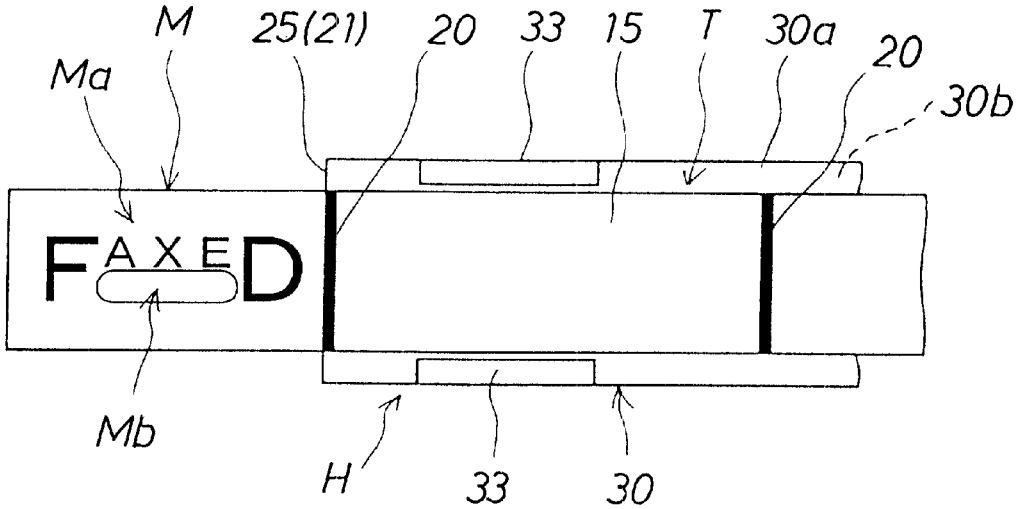
FIG. 4B is a plan showing essential parts of transfer head of the mark transfer tool.

That is, the mark transfer tape T paid out from the pay-out reel 11 is guided into the leading end pressing portion 25 along the tape running surface at one side of the transfer head H, and passes through the leading end pressing portion 25 and is inverted, and is further guided along the tape running surface of the opposite side, and taken up on the take-up reel 12, and as shown in FIG. 4A and FIG. 4B, the transfer completion position of one transfer mark M is indicated when the visual recognition line 20 of the mark transfer tape T visually coincides with the leading end pressing portion 25 of the transfer head H.

The mark transfer tape T in the shown embodiment is manufactured as a band having a tape width corresponding to plural mark transfer tapes T, T, . . . as shown in FIG. 5A, and cut and formed in a width of one tape T by slitter or other cutting device.

According to a specific forming method of the transfer mark layer 16, the mark forming layer 17 is applied and formed on the surface of the base tape 15, after printing and forming the visual recognition line 20, the mark array layer 18 is printed and formed on the surface of the mark forming layer 17, and the pressure-sensitive adhesive layer 19 is applied and formed thereon.

The transfer head H presses the mark transfer tape T to a transfer area on a sheet of paper, and it is disposed at the leading end of the cartridge case 10, and has a function of guiding the mark transfer tape T and a function of pressing.

A specific structure of the transfer head H comprises a head main body 30, a head holding portion 31, and a rotary operation portion 32. The head main body 30 is held rotatably about its axial center, that is, a so-called rotary head structure is formed.

The head main body 30 is to press and transfer the mark transfer tape T, and is shaped to be suited to transfer accurately to a desired transfer position, that is, in a pointed form.

The head main body 30 in the shown example is a thin plate having a rectangular shape slightly wider than the mark transfer tape T, and has a taper section, being pointed in a side view so as to be gradually thin toward the leading end. The head main body 30 has flat both side surfaces 30*a*, 30*b*, which form tape running surfaces, and a leading edge 25 is a leading end pressing portion for pressing the mark transfer tape T as mentioned above, and also function as the visual recognition positioning part 21. This leading end pressing portion 25 is a straight edge orthogonal to the tape running direction in the tape running surfaces 30*a*, 30*b*. At both side edges of the head main body 30, guide flanges 33, 33 are formed for guiding running of mark transfer tape T.

If the thickness of the plate for composing the head main body 30 is relatively small, tapering as shown in the drawing is not always necessary, but the plate thickness may be uniform throughout the longitudinal direction, and anyway the structure is not particularly specified as far as the leading end of the pressing portion 25 of the head main body 30 has a thickness (a point) enough to position and indicate the transfer position accurately.

At the base end side portion of the head main body 30, further, a borne portion 35 is integrally formed as a main body support.

The head holding portion 31 supports the head main body 30 rotatably bout its axial center, and specifically comprises a borne portion 35 as the main body support, and a bearing 36 provided in the cartridge 10.

Figure 6A:
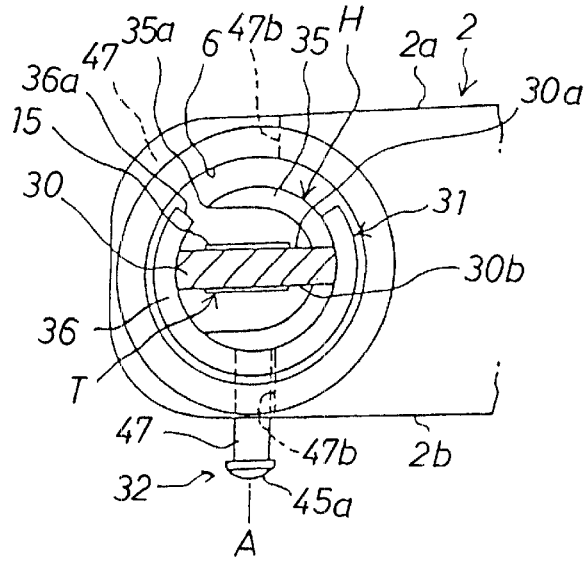
FIGS. 6A–6C are magnified front views showing a partial section of rotating structure of transfer head for the mark transfer tool.
Figure 6B:
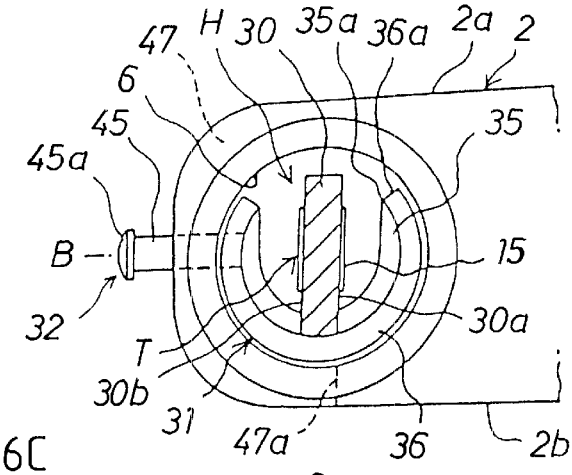
Figure 6C:
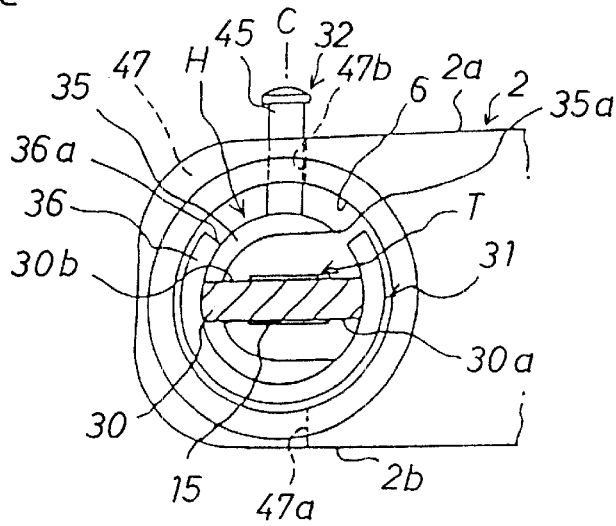

The borne portion 35 is, as shown in FIGS. 6A–6C, a cylindrical portion provided concentrically and integrally with the head main body 30, and more specifically it is formed in an arc section having a setting opening 35*a* of mark transfer tape T to the head main body 30 in a part thereof.

The bearing 36 is disposed integrally at the leading end of the cartridge case 10. As shown in FIGS. 6A–6C, the bearing 36 is tubular having an inner circumference corresponding to the outer circumference of the borne portion 35, and same as the borne portion 35, it is formed in an arc section having a setting opening 36*a* of mark transfer tape T to the head main body 30 in a part thereof. The born portion 35 is slidably supported on the bearing 36, and the head main body 30 is freely rotatable about the axial center in a specified rotating angle range described below.

The rotary operation portion 32 is to determine the rotating direction position of the head main body 30, and also serves as head position indicator to show the tape pressing and transferring position of the head main body 30.

The rotary operation portion 32 is a circular bar, and has an operation lever 45 including an operation knob 45*a* disposed at its leading end as a principal unit. The operation lever 45 is extended linearly outward in the radial direction from the axial center of the born portion 35, and projects to the outside of the case 2, through a slit inserting portion 46 and an operation guide portion 47 disposed at corresponding positions in the bearing 36 and case 2. In this case, the inserting portion 46 of the bearing 36 functions as a locking portion of the head main body 30 to prevent it from slipping out in the axial direction.

The location of the operation lever 45 in the rotating direction with respect to the head main body 30 is set in relation to the tape pressing and transferring position of the head main body 30, and the slit inserting portion 46 and operation guide portion 47 are extended in the peripheral direction so as to allow moving of the operation lever 45 in the rotating direction of the head main body 30. In particular, the operation guide portion 47 of the case 2 defines the operating range in the rotating direction of the operation lever 45, and is configured to control the tape pressing and transferring position of the head main body 30.

The relation of the operation lever 45 and the tape pressing and transferring position of the head main body 30 is explained with respect to the operation guide portion 47. In the shown embodiment, the configuration of the operation guide portion 47 as the operation range defining portion in the rotating direction is set follows, referring to FIGS. 6A–6C.

(a) When the operation lever 45 is in contact with one end 47*a* of the operation guide portion 47, that is, in the vertical downward position (first defined position A shown in FIG. 6A), the head main body 30 of the transfer head H is located at an angular position for guiding its leading end pressing portion 25 so that the mark transfer tape T may be nearly opposite to the gripping surfaces 2*a,* 2*b* of the case 2, that is, the face and back sides of the mark transfer tape T may be directed nearly in the same direction as (parallel to) the gripping surfaces 2*a,* 2*b*.

Figure 7A:
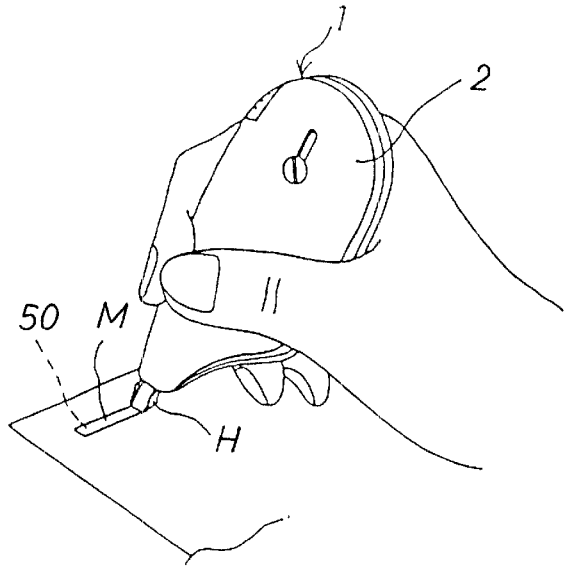
FIG. 7A is a perspective view of state of use of the mark transfer tool, showing a state of use of lateral pull by the right hand.

In this case, the new mark transfer tape T rolled out from the pay-out reel 11 is at the lower side of the head main body 30, and is in a state suited to use by lateral pull by a right-handed user (see FIG. 7A).

(b) When the operation lever 45 is at an intermediate position between both ends 47*a,* 47*b* of the operation guide portion 47 of the operation lever, that is, in the horizontal downward position (second defined position B shown in FIG. 6B), the head main body 30 of the transfer head H is located at an angular position for guiding its leading end pressing portion 25 so that the mark transfer tape T may remain in wound state on the pay-out reel 11 and take-up reel 12, that is, the face and back sides of the mark transfer tape T may be directed nearly in a nearly vertical direction (orthogonal) to the gripping surfaces 2*a,* 2*b*.

Figure 7B:
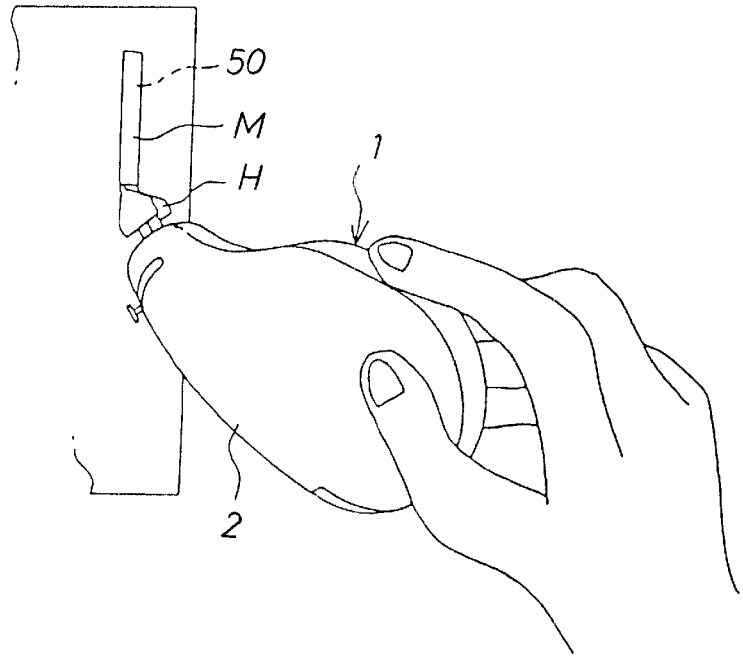
FIG. 7B is a perspective view of state of use of the mark transfer tool, showing a state of use of lateral pull by the left hand.

In this case, the new mark transfer tape T rolled out from the pay-out reel 11 is at the left side of the head main body 30, and is in a state suited to use by vertical pull (see FIG. 7B).

(c) When the operation lever 45 is in contact with other end 47*b* of the operation guide portion 47, that is, in the vertical upward position (third defined position C shown in FIG. 6C), the head main body 30 of the transfer head H is located at an angular position for guiding its leading end pressing portion 25 so that the mark transfer tape T may be nearly opposite to the gripping surfaces 2*a,* 2*b* of the case 2, in the upside down state of the case (a) above.

Figure 7C:
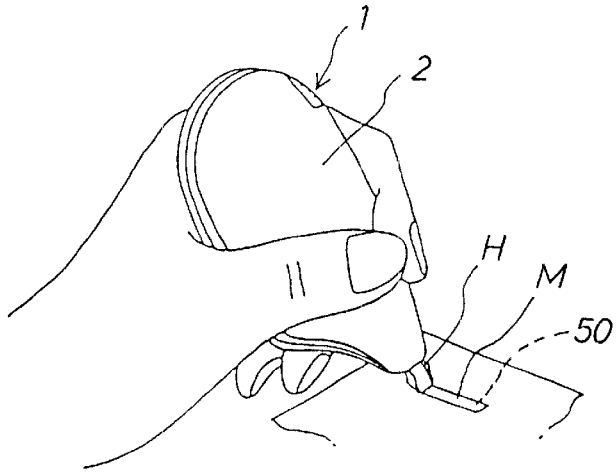
FIG. 7C is a perspective view of state of use of the mark transfer tool, showing a state of use of vertical pull by the right hand.

In this case, the new mark transfer tape T rolled out from the pay-out reel 11 is at the upper side of the head main body 30, and is in a state suited to use by lateral pull by a left-handed user (see FIG. 7C).

As clear from the description above, the direction of the operation lever 45 directly and visually shows the opposite direction of the new mark transfer tape T (function as head position indicator), and the user can confirm the tape pressing and transferring position of the head main body 30 by referring to the direction of the operation lever 45.

The rotating direction operating range of the operation guide portion 47 (nearly 180 deg. at maximum in shown example) can be set in various desired values from a small angle range to a large angle range in consideration of relation between the operation lever 45 and the tape pressing and transferring position of the head main body 30.

Using the mark transfer tool 1 having such configuration, to transfer the transfer mark on the mark transfer tape onto a desired transfer area 50 on a sheet of paper or the like, whether the user is right-handed or left-handed as mentioned above, the operation lever 45 can be rotated according to the purpose, and an optimum tape pressing and transferring position of the head main body 30 of the transfer head H (typically, first defined position A shown in FIG. 6A, second defined position B shown in FIG. 6B, or third defined position C shown in FIG. 6C) can be selected and set, and corresponding to this position, the case 2 can be gripped by finger son the gripping surfaces (standard gripping surfaces are face and back sides 2*a,* 2*b* of the case 2, but proper positions or sides of the case 2 may be gripped depending on the purpose), so that various methods of use, for example, as shown in FIG. 7A to FIG.7C may be possible.

That is, in any method of use, the gripping surfaces of the case 2 are held like holding a writing tool, and the leading end pressing portion 25 of the transfer head H is pressed tightly to the transfer start end of the transfer area 50 on a sheet of paper or the like, and the case 2 is moved along the sheet of paper by a specified distance and stopped.

More specifically, with the visual recognition line 20 provided in the mark transfer tape T visually coinciding with the visual recognition positioning part 21 of the transfer head H, that is, the leading end pressing portion 25, the transfer head H is tightly pressed to the transfer start end on the transfer area 50, and the case 2 is directly moved along the sheet of paper, and is stopped when the next visual recognition line 20 coincides with the visual recognition positioning part 21.

By this operation, the transfer mark M of the mark transfer tape T in the leading end pressing portion 25 of the transfer head H is peeled from the base tape 15, and transferred onto the transfer area 50, and the used mark transfer tape T after the transfer mark M is peeled off, that is, the base tape 15 is taken up and collected on the take-up reel 12.

Figure 8A:
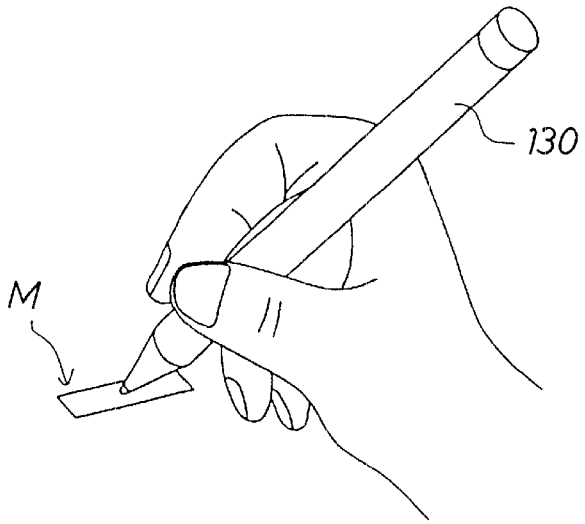
FIG. 8A is a perspective view showing an overwriting state by a writing tool after transfer mark by the mark transfer tool.

After the transfer mark M on the mark transfer tape T is transferred on the transfer area 50, as shown in FIG. 8A, desires characters (the date in the shown case) can be written over by the writing tool 130 on the overwriting blank space Mb of the mark M.

Thus, the transfer mark M is composed of the mark Ma and overwriting blank space Mb, and therefore it is possible to write on a position of a material not written directly by the writing tool 130 or a material not erased cleanly if once written.

Since the mark transfer tool 1 of the embodiment has a cartridge structure for exchanging the mark transfer tape T, various transfer marks M, M, . . . depending on the purpose of use can be transferred and used by preparing a plurality of tape cartridges C having mark transfer tapes T of plural types of transfer marks M, M, . . . .

Figure 8B:
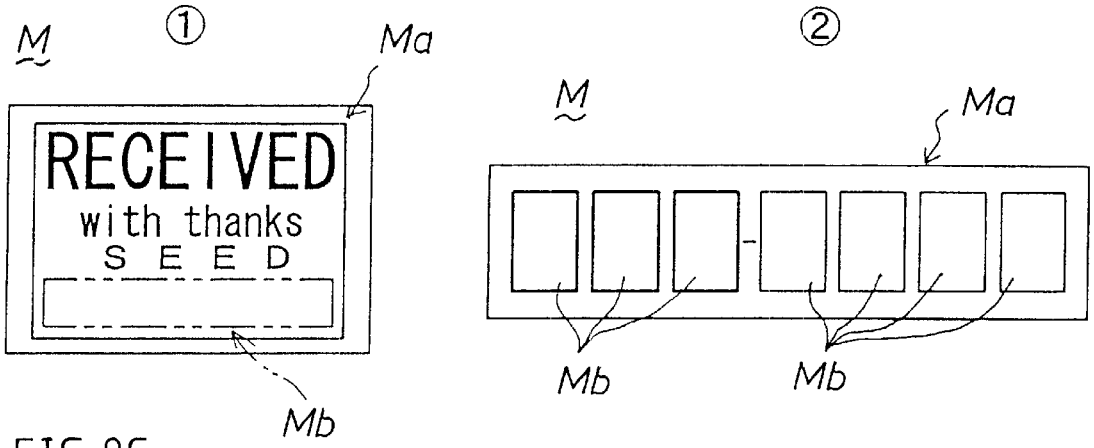
FIG. 8B is a plan showing a modified example of the transfer mark.
Figure 8C:
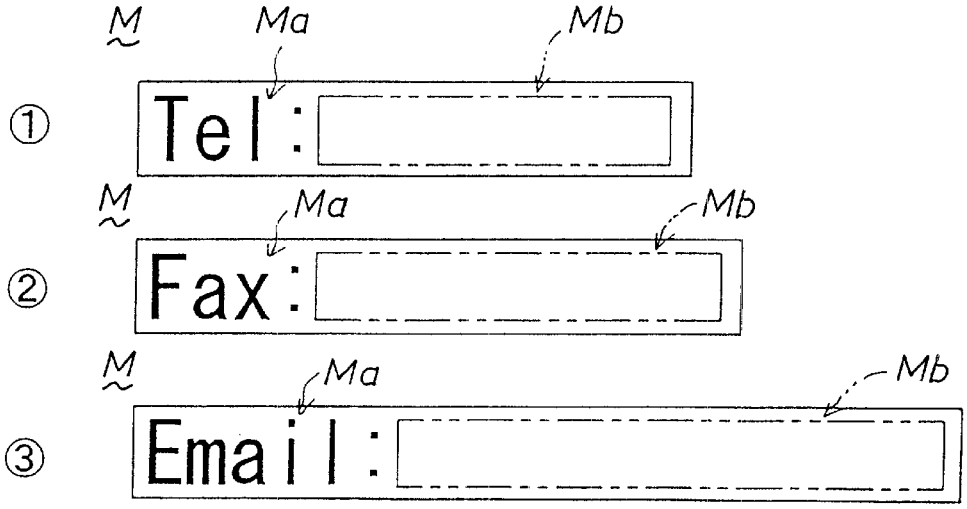
FIG. 8C is a plan showing other modified example of the transfer mark.

Other examples of the transfer mark M (mark Ma and overwriting blank space Mb) are shown in FIG. 8B and FIG. 8C.

That is, as shown in FIG. 8B, same as mentioned above, the mark Ma and overwriting blank space Mb are integrated, in which ① is composed of mark Ma "RECEIVED/with thanks/SEED" and matching overwriting blank space Mb for entering the date.

Further, ② has a rectangular mark Ma with seven overwriting blank spaces Mb consisting of with three cells enclosed with lines and four cells enclosed with thin lines for entering the Japanese postal system code (consisting of seven digits).

In FIG. 8C, ① is the mark Ma "Tel:" followed by blank entry space Mb at the right side for entering the telephone number.

Next ② is the mark Ma "Fax:" followed by blank entry space Mb at the right side for entering the facsimile number.

Finally, ③ is the mark Ma "Email:" followed by blank entry space Mb at the right side for entering the e-mail address.

Embodiment 2

Figure 9A:
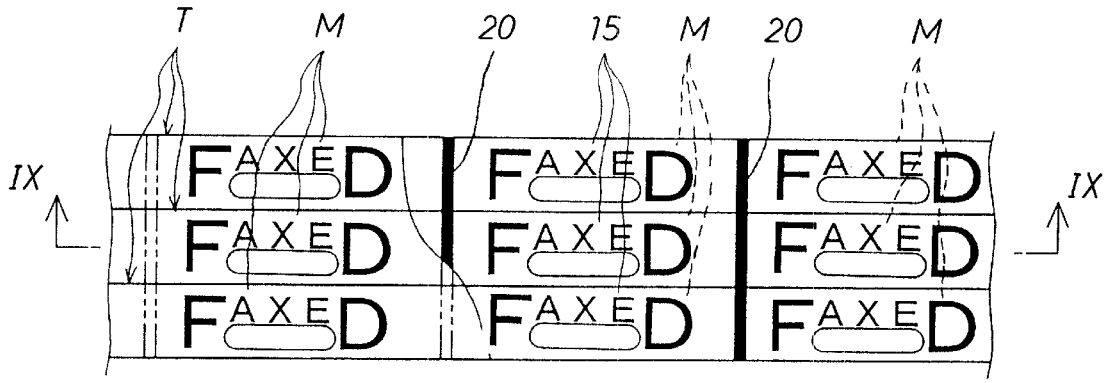
FIG. 9A is a plan of mark transfer tool of a mark transfer tool according to embodiment 2 of the invention, showing a partially cut-away view of the mark transfer tape in the manufacturing process.
Figure 9B:
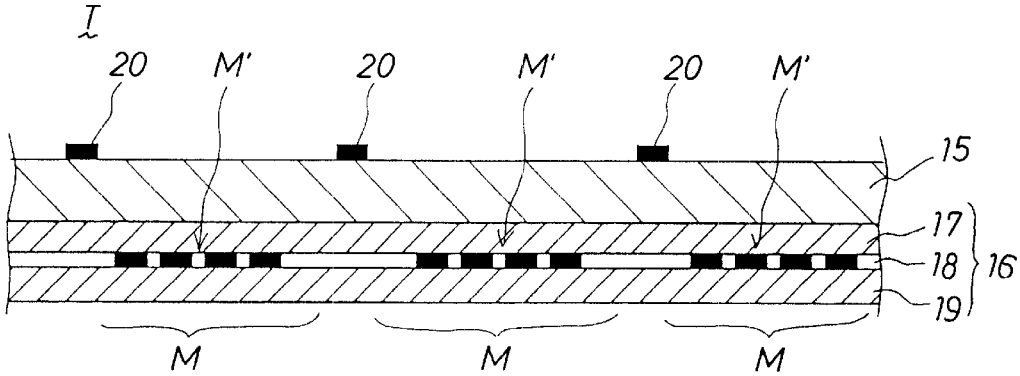
FIG. 9B is a sectional view along line IX—IX in FIG. 9A of the mark transfer tape.
Figure 9C:
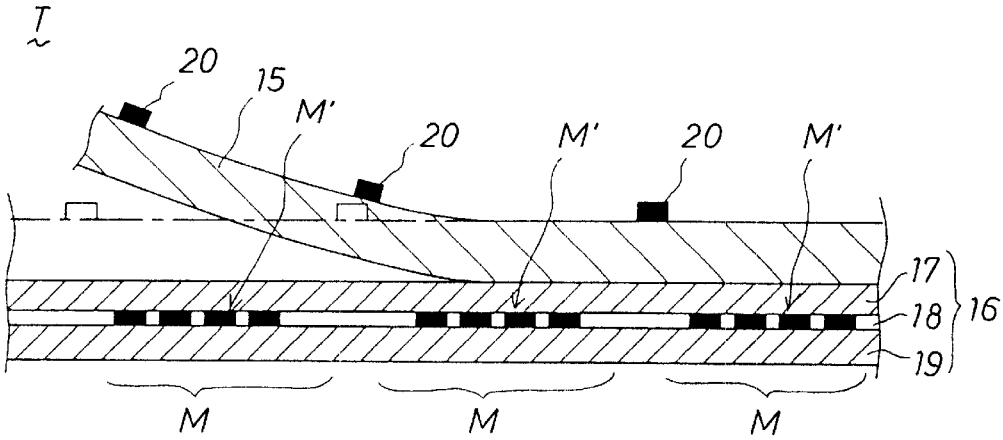
FIG. 9C is a sectional view showing a peeling state of base tape and transfer mark layer of the mark transfer tape.

This embodiment is shown in FIGS. 9A–9C, in which the specific structure of the mark transfer tape T in embodiment 1 is slightly modified.

That is, the mark transfer tape T of the embodiment is made of a transparent film material so that the base tape 15 may be seen through, and the visual recognition line 20 as the division visual recognition means is provided at the back side (the upper side in FIG. 9B and FIG. 9C) of the base tape 15.

The visual recognition line 20 is composed of a transparent adhesive material so that the mark forming layer 17 and pressure-sensitive adhesive layer 19 of the transfer mark layer 16 can be seen through, and also the base tape 15 is also made of a see-through transparent film material, so that it is visible from the surface side of the base tape 15, whether the transfer mark layer 16 is present or not.

The other configuration and operation are same as in embodiment 1.

Embodiment 3

Figure 10A:
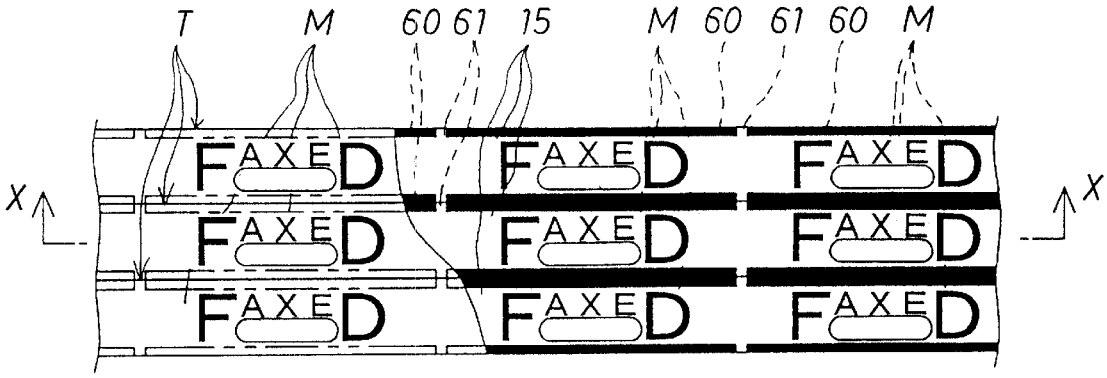
FIG. 10A is a plan of mark transfer tool of a mark transfer tool according to embodiment 3 of the invention, showing a partially cut-away view of the mark transfer tape in the manufacturing process.
Figure 10B:
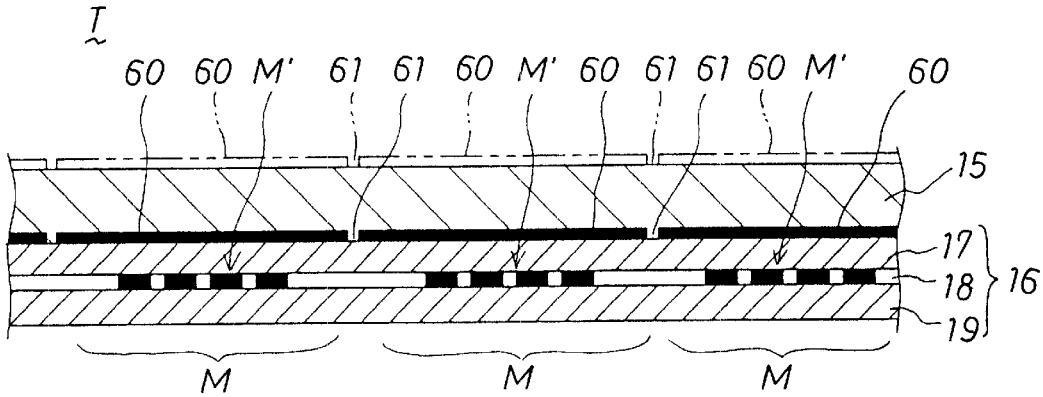
FIG. 10B is a sectional view along line X—X in FIG. 10A of the mark transfer tape.
Figure 10C:
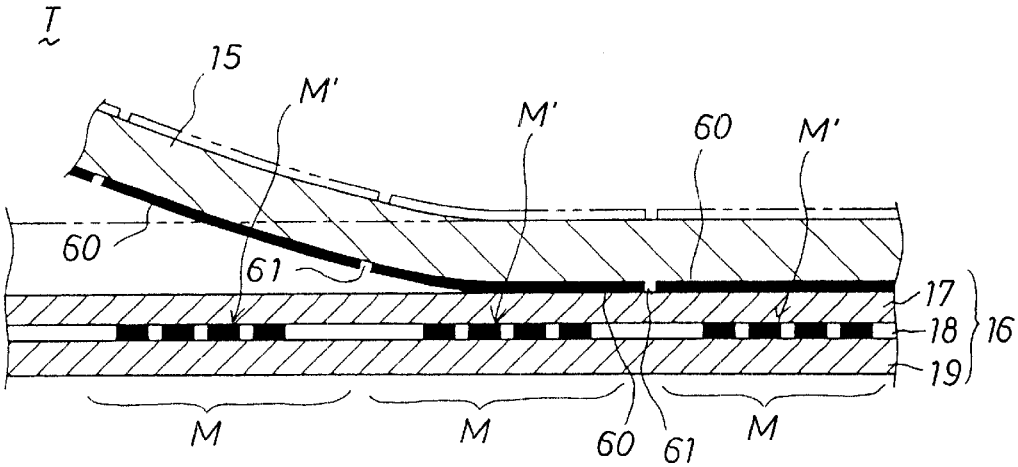
FIG. 10C is a sectional view showing a peeling state of base tape and transfer mark layer of the mark transfer tape.

This embodiment is shown in FIGS. 10A–10C, in which the specific structure of the mark transfer tape T in embodiment 1 is slightly modified.

That is, in the mark transfer tape T of this embodiment, at least at one edge in the width direction of the base tape 15 (both edges in the shown case), mark indication lines 60 indicating the transfer length range of the transfer marks M, M, . . . are provided, and the boundary of the mutually adjacent mark indication lines 60, 60 is the division visual recognition part 61.

The mark indication line 60 shown in FIGS. 7A–7C is provided on the surface of the base tape 15 (lower side in FIG. 10B and FIG. 10C), and its forming length is set to coincide with the transfer length of the transfer mark M in the transfer mark layer 16.

In the mark transfer operation of the mark transfer tool 1, it is composed to indicate the transfer completion position of one transfer mark M when the boundary (division visual recognition part) 61 coincides with the visual recognition positioning part 21 of the transfer head H, that is, the leading end pressing portion 25.

Same as in embodiment 2, like the holding mark forming layer 17 and pressure-sensitive adhesive layer 19 in the transfer mark layer 16, when the transfer tape 15 is also made of a see-through transparent film material, the mark indication line 60 may be provided also at the back side of the base tape 15 (see double dot chain line in FIG. 10B and FIG. 10C). In this case, the mark indication line 60, that is, the boundary 61 can be visible from the surface side of the base tape 15 whether the transfer mark layer 16 is present or not.

The other configuration and operation are same as in embodiment 1.

Embodiment 4

Figure 11A:
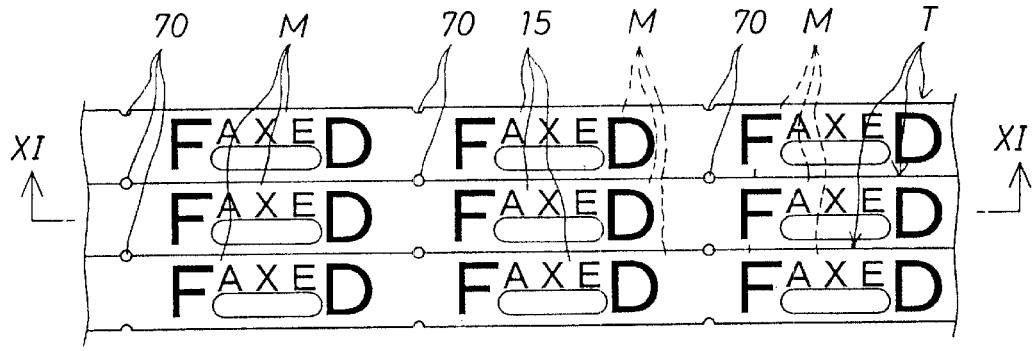
FIG. 11A is a plan of mark transfer tool of a mark transfer tool according to embodiment 4 of the invention, showing a partially cut-away view of the mark transfer tape in the manufacturing process.
Figure 11B:
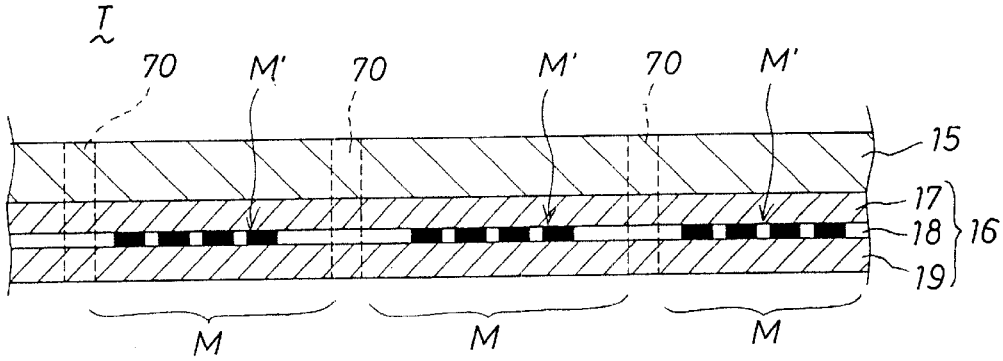
FIG. 11B is a sectional view along line XI—XI in FIG. 11A of the mark transfer tape.
Figure 11C:
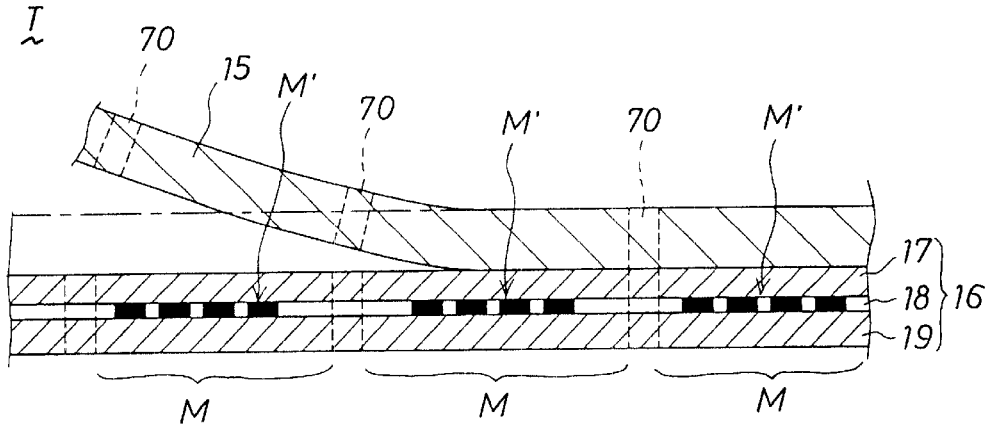
FIG. 11C is a sectional view showing a peeling state of base tape and transfer mark layer of the mark transfer tape.

This embodiment is shown in FIGS. 11A–11C, in which the specific structure of the mark transfer tape T in embodiment 1 is slightly modified.

That is, in the mark transfer tape T of this embodiment, division visual recognition means 70 is formed as a notch for visual recognition penetrating in the thickness direction of the base tape 15 between the mutually adjacent transfer marks M, M in the base tape 15.

The shown visual recognition notch 70 is provided at least at one edge in the width direction of the base tape 15 (both edges in the shown case), and a visual recognition positioning part is provided at the surface position of the transfer head H adjacent to the passing route of the visual recognition notch 70.

The visual recognition notch 70 is an arc-shaped notch (semicircular in the shown case) in order to prevent breakdown of the base tape 15 by concentration of stress.

The visual recognition positioning part is, although not specifically shown, provided at a position capable of visually recognizing the tape running portion of the transfer head H, same as in embodiment 1, and the leading end pressing portion 25 of the transfer head H also plays this role in the shown embodiment.

In the mark transfer operation of the mark transfer tool 1, it is composed to indicate the transfer completion position of one transfer mark M when the visual recognition notch 70 coincides with the visual recognition positioning part, that is, the leading end pressing portion 25. The other configuration and operation are same as in embodiment 1.

The mark transfer tape T of the embodiment is, same as in embodiment 1, manufactured as a band having a tape width dimension of plural mark transfer tapes T, T, . . . as shown in FIG. 11A, and is cut and formed in a width of one tape T by a slitter or cutter.

Actually, therefore, after the transfer mark layer 16 is formed on the surface side of the base tape 15, the division visual recognition means 70 is punched through by a punch or other drilling machine, so that the division visual recognition means 70 penetrates through the entire mark transfer tape T.

Embodiment 5

Figure 12A:
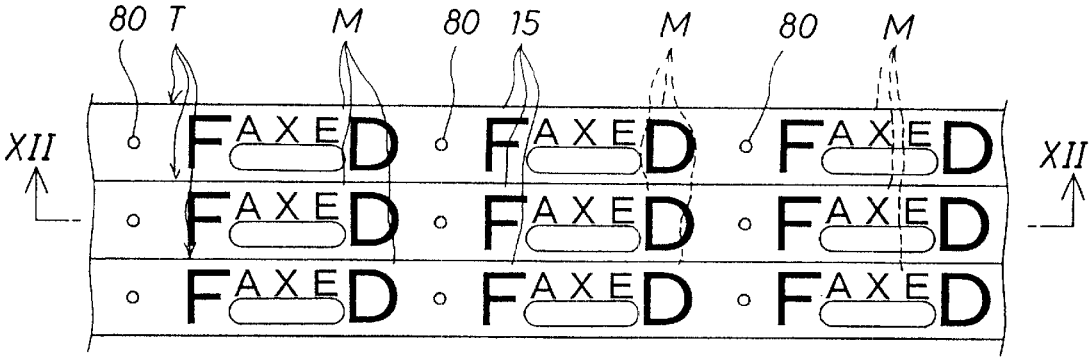
FIG. 12A is a plan of mark transfer tool of a mark transfer tool according to embodiment 5 of the invention, showing a partially cut-away view of the mark transfer tape in the manufacturing process.
Figure 12B:
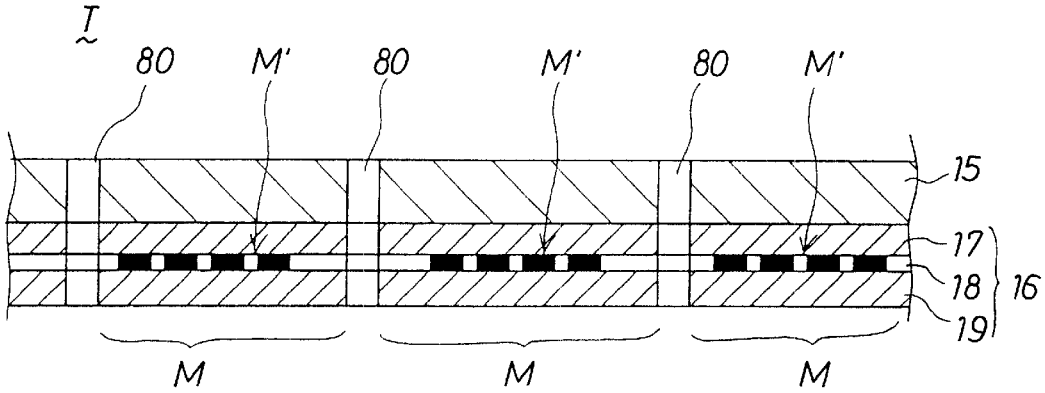
FIG. 12B is a sectional view along line XII—XII in FIG. 12A of the mark transfer tape.
Figure 12C:
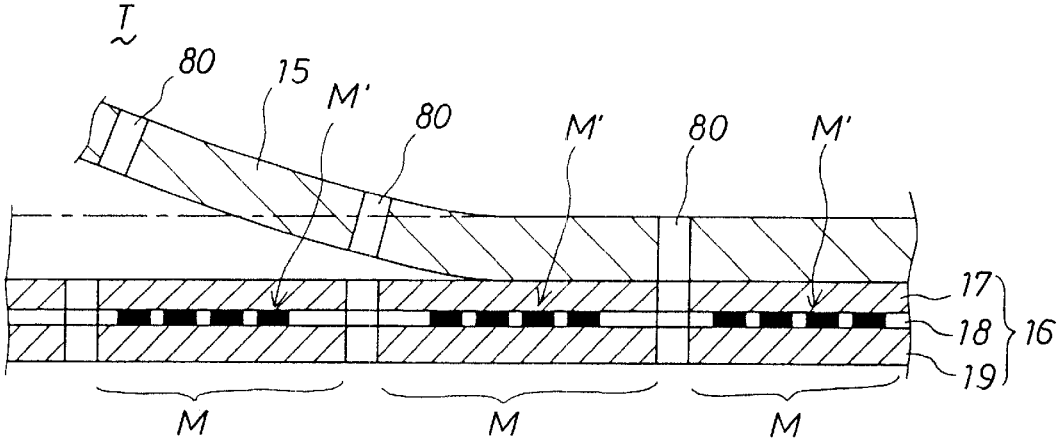
FIG. 12C is a sectional view showing a peeling state of base tape and transfer mark layer of the mark transfer tape.

This embodiment is shown in FIGS. 12A–12C, in which the specific structure of the division visual recognition mean 70 in embodiment 4 is slightly modified.

That is, it is same as in embodiment 4 that the division visual recognition means 80 of the embodiment is a notch for visual recognition penetrating in the thickness direction of the base tape 15 between the mutually adjacent transfer marks M, M in the base tape 15, but the division visual recognition notch 80 of the embodiment is a hole for visual recognition provided in the center in the width direction of the base tape 15.

The visual recognition hole 80 is a tiny circular hole to prevent tearing of base tape 15 due to stress concentration.

The other configuration and operation are same as in embodiment 4.

Embodiment 6

Figure 13A:
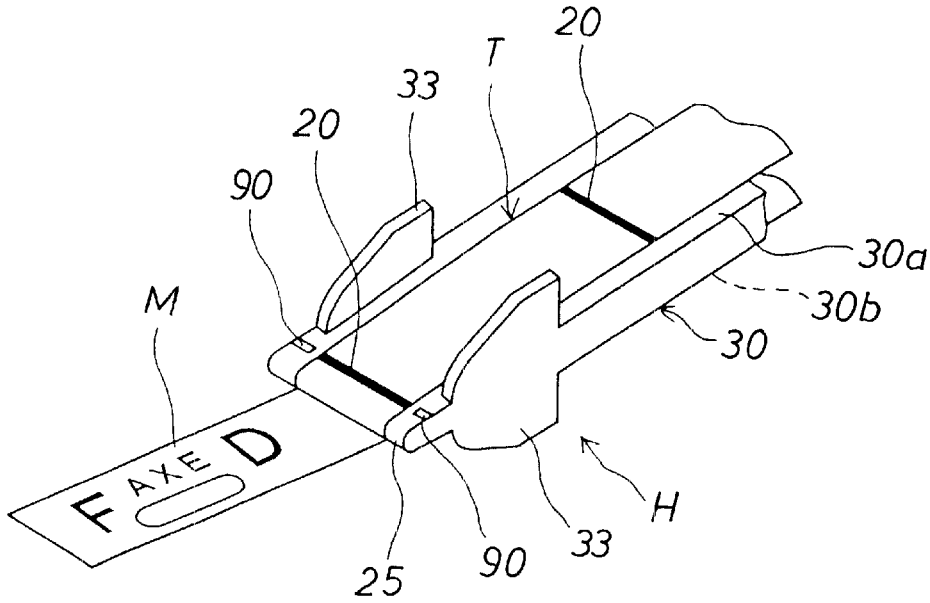
FIG. 13A is a perspective view showing essential parts of transfer head of a mark transfer tool according to embodiment 6 of the invention.
Figure 13B:
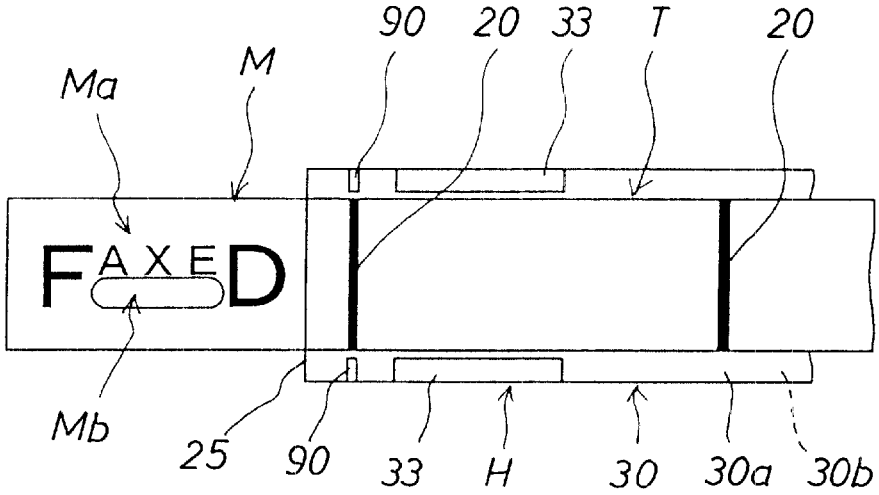
FIG. 13B is a plan showing essential parts of the transfer head.

This embodiment is shown in FIGS. 13A and 13B, in which the specific structure of the transfer head H in embodiment 1 is slightly modified.

That is, a visual recognition positioning part 90 of the embodiment is independent of the leading end pressing portion 25 of the transfer head H, and is formed as a positioning index provided on the surface of the transfer head H.

This positioning index 90 is provided on the tape traveling surface 30*a* at the upper side for guiding traveling of used mark transfer tape T, that is, the base tape 15 of the tape traveling surfaces 30*a,* 30*b* of the head main body 30 of the transfer head H.

The positioning index 90 is, specifically, a swollen bump integrally formed simultaneously with forming of the head main body 30, and its position is set at both side positions in the width direction of the mark transfer tape T, slightly behind the leading end pressing portion 25.

By contrast, the position of the visual recognition line 20 of the mark transfer tape T is also set to indicate the transfer completion position of one transfer mark M when the visual recognition line 20 coincides with the positioning index 90 in the mark transfer operation of the mark transfer tool 1.

In this configuration, the coinciding position of the visual recognition line 20 and positioning index 90 is a position allowing the user to view oppositely, so that the coinciding position of the two, that is, the transfer completion position of the transfer mark M can be visually recognized more easily and securely.

The plane shape of the positioning index 90 is linear parallel to the leading end pressing portion 25 as shown, but circular or other shape usable as index may be also employed. The positioning index 90 herein is a bump swollen from the tape traveling surface 30*a,* but it may be formed as a recess sinking from the tape traveling surface 30*a,* or may be indicated by a paint or the like.

The other configuration and operation are same as in embodiment 1.

Embodiment 7

Figure 14A:
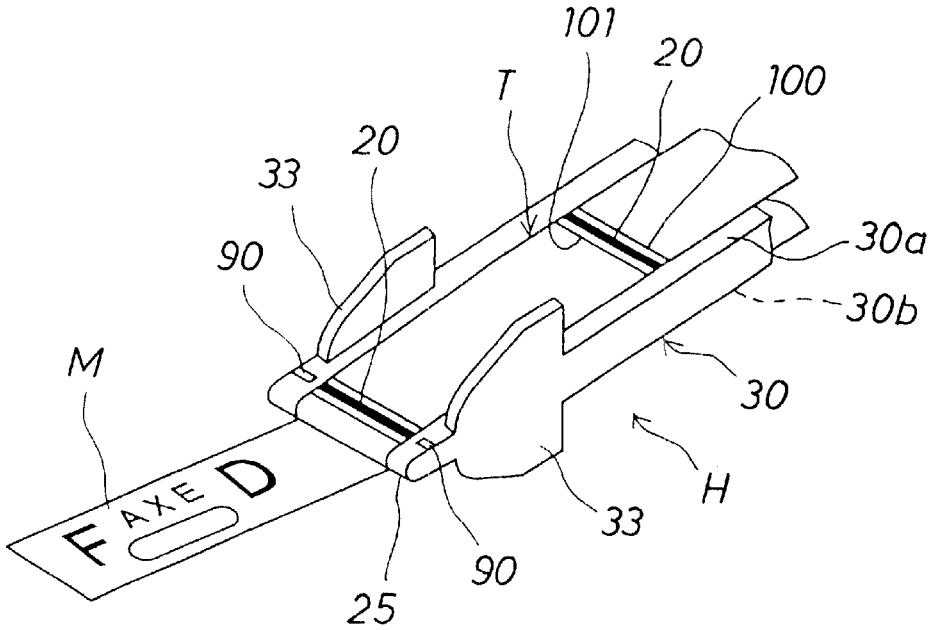
FIG. 14A is a perspective view showing essential parts of transfer head of a mark transfer tool according to embodiment 7 of the invention.
Figure 14B:
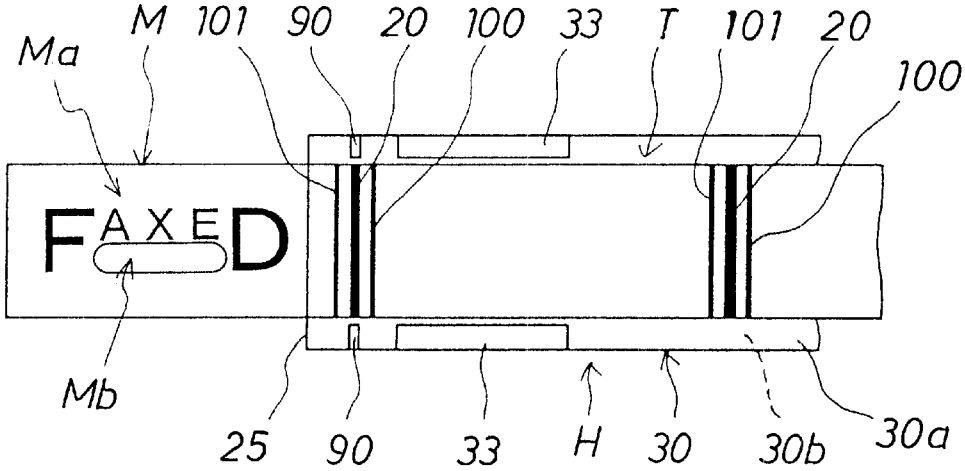
FIG. 14B is a plan showing essential parts of the transfer head.

This embodiment is shown in FIGS. 14A and 14B, in which the specific structure of the transfer tape T in embodiment 1 is slightly modified, while utilizing the structure of the transfer head H in embodiment 6.

That is, the mark transfer tape T of the embodiment is provided with division allowable visual recognition parts 100, 101, at least at one side (both sides in the shown case) of the upstream side and downstream side in the tape running direction of the visual recognition line 20.

These division allowable visual recognition parts 100, 101 are, same as the visual recognition line 20, provided on the surface of the base tape 15 by printing or other known method, and can be seen from the surface side of the base tape 15 whether the transfer mark layer 16 is present or not.

The division allowable visual recognition parts 100, 101 are extended linearly in the width direction of the base tape 15 parallel to the visual recognition line 20 between transfer marks M and M of the transfer mark layer 16. The division allowable visual recognition parts 100, 101 are different in thickness from the visual recognition line 20 so as not to be confused with the visual recognition line 20 (thinner line in the shown case).

The upstream side division allowable visual recognition part 100 indicates the allowable limit of transfer completion position of the transfer mark in the tape running direction. That is, in the mark transfer operation of the mark transfer tool 1, until the division allowable visual recognition part 100 coincides with the visual recognition positioning part 21 of the transfer head H, the transfer operation of one transfer mark M should not be stopped, and when coinciding, it tells that the transfer completion position (visual recognition line 20) is approaching.

On the other hand, the downstream side division allowable visual recognition part 101 indicates the allowable limit of transfer start position in the tape running direction. That is, in the mark transfer operation of the mark transfer tool 1, when the division allowable visual recognition part 101 coincides with the visual recognition positioning part 21 of the transfer head H. it tells that the transfer operation of the next transfer mark M must be started. In this case, when the visual recognition line 20 coincides with the visual recognition positioning part 21, it indicates the transfer completion position, and it tells that the transfer start position (division allowable visual recognition part 101) is approaching.

In this constitution, completion of transfer of transfer mark M or limit of start is known, so that more accurate and precise transfer operation is realized.

The other configuration and operation are same as in embodiment 1.

Embodiment 8

Figure 15:
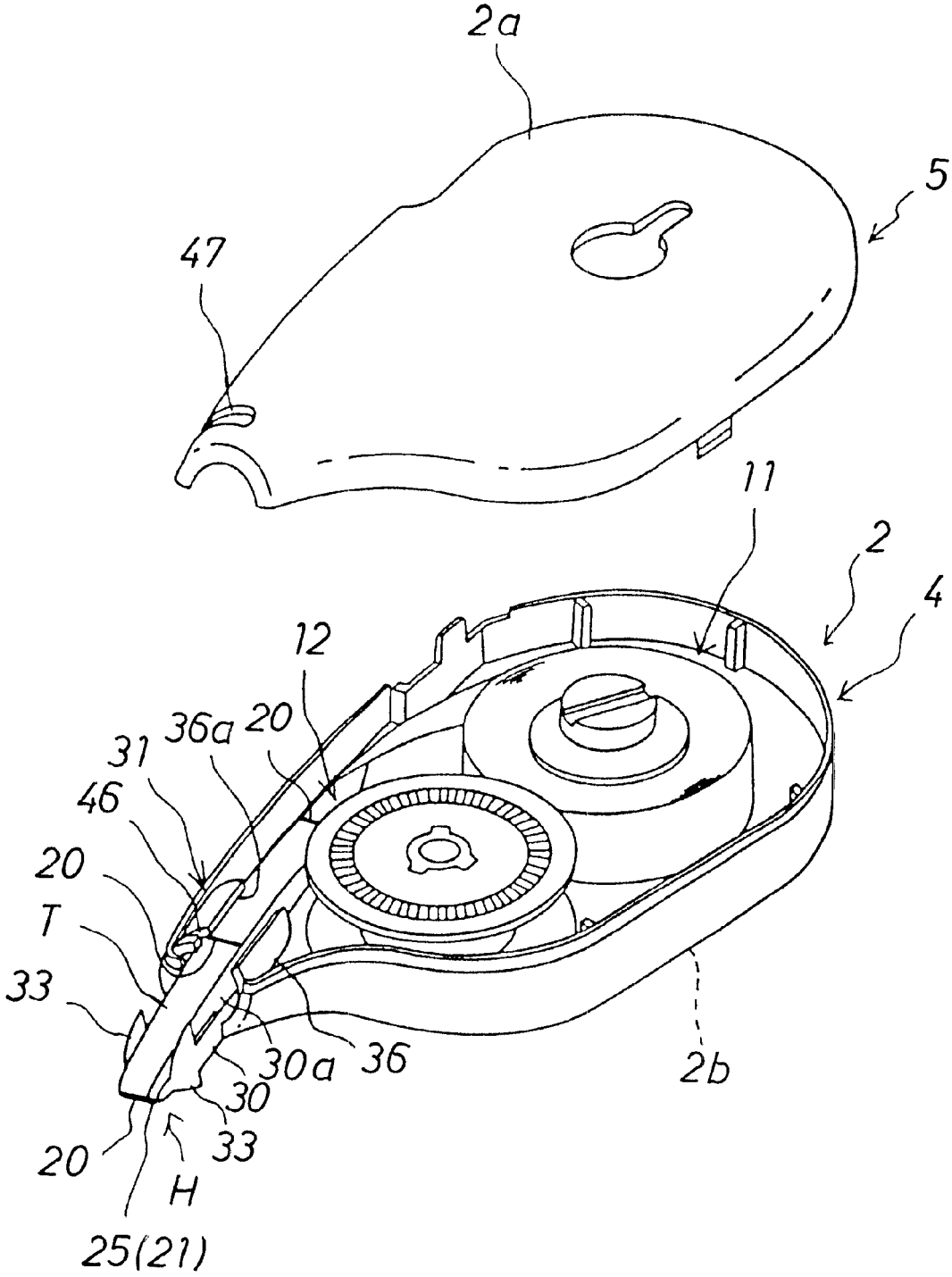
FIG. 15 is a perspective exploded view of a mark transfer tool according to embodiment 8 of the invention.

This embodiment is shown in FIG. 15, in which the basic structure of the mark transfer tool 1 is modified.

That is, in the mark transfer tool 1 of the foregoing embodiments, the mark transfer tape T as a consumable part is an exchangeable cartridge type, that is, refill type, whereas this embodiment presents a one-time disposable type, that is, all component parts including the mark transfer tape T are consumable parts.

In the mark transfer tool 1 of the embodiment, in a hand-held case 2, a pay-out reel 11 on which a mark transfer tape T is wound, and a take-up reel 12 for collecting the mark transfer tape T after use are installed, and a transfer head H is disposed at the leading end of the case 2 so as to be rotatable about its head axial center. The specific structure of the transfer head H is same as in embodiment 1, except for its mounting position.

Although not shown specifically, in the case main body 4 of the case 2, aside from the pay-out reel 11 and take-up reel 12, a tape interlock unit for mutually interlocking these reels 11, 12, a clutch mechanism for synchronizing the pay-out speed and take-up speed of the mark transfer tape T by the pay-out reel 11 and take-up reel 12, and other principal and basic mechanical parts are also assembled in a unit.

The other configuration and operation are same as in embodiment 1.

Embodiment 9

Figure 16A:
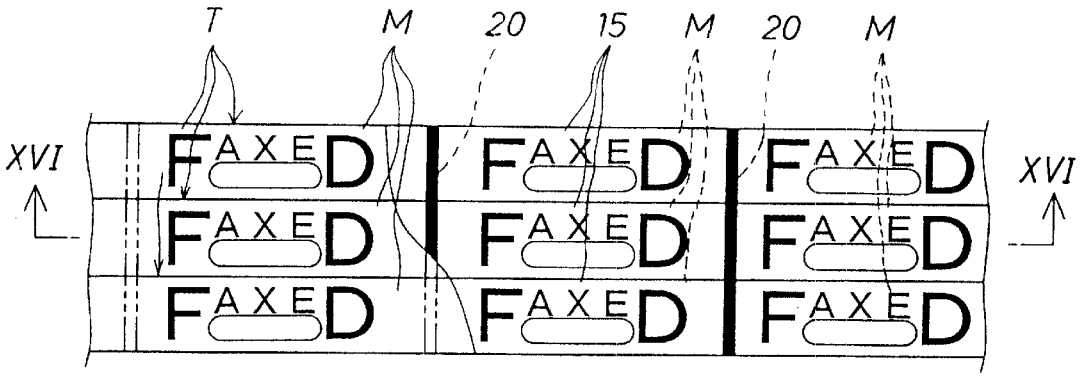
FIG. 16A is a plan of mark transfer tool of a mark transfer tool according to embodiment 9 of the invention, showing a partially cut-away view of the mark transfer tape in the manufacturing process.
Figure 16B:
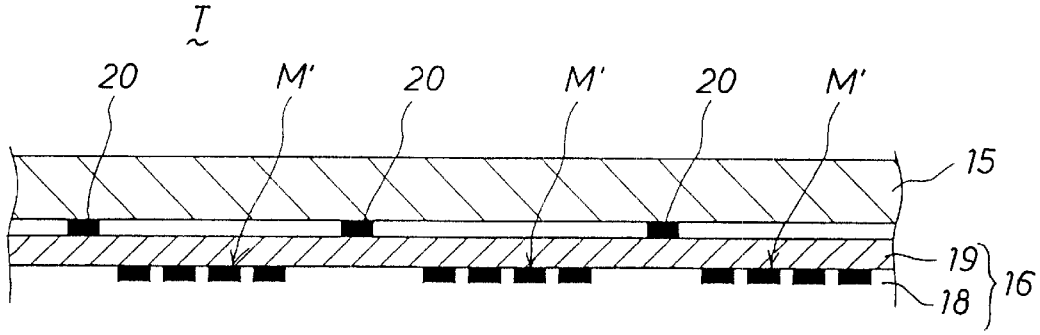
FIG. 16B is a sectional view along line XVI—XVI in FIG. 15A of the mark transfer tape.
Figure 16C:
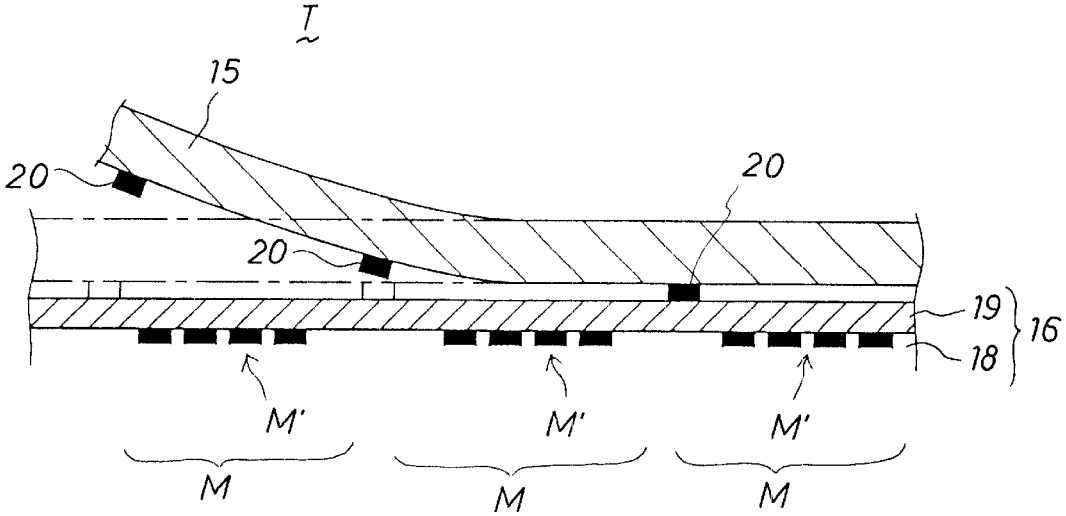
FIG. 16C is a sectional view showing a peeling state of base tape and transfer mark layer of the mark transfer tape.

This embodiment is shown in FIGS. 16A–16C, in which the structure of the mark transfer tape T is modified.

That is, in the mark transfer tape T of this embodiment, as shown in FIGS. 16A–16C, a transfer mark layer 16 to be adhered and held on the surface side (lower side in FIG. 16B and FIG. 16C) of a base tape 15 is an integral laminate structure consisting of a pressure-sensitive adhesive layer 19 and a mark array layer 18.

In the embodiment, the pressure-sensitive adhesive layer 19 also functions as the mark forming layer 17 in embodiment 1, and the mark array layer 18 is printed and formed on the surface of this pressure-sensitive adhesive layer 19.

Thus laminated transfer mark layer 16 is, as shown, adhered and held on the surface of the base tape 15 treated for parting (the lower side in FIG. 16B and FIG. 16C) peelably and separably through the pressure-sensitive adhesive layer 19.

In a specific forming method of the transfer mark layer 16, the visual recognition line 20 is printed and formed on the surface of the base tape 15, and the pressure-sensitive adhesive layer 19 is applied and formed on the surface of the base tape 15, and the mark array layer 18 is printed and formed on the surface of the pressure-sensitive adhesive layer 19.

The other configuration and operation are same as in embodiment 1.

Embodiment 10

Figure 17A:
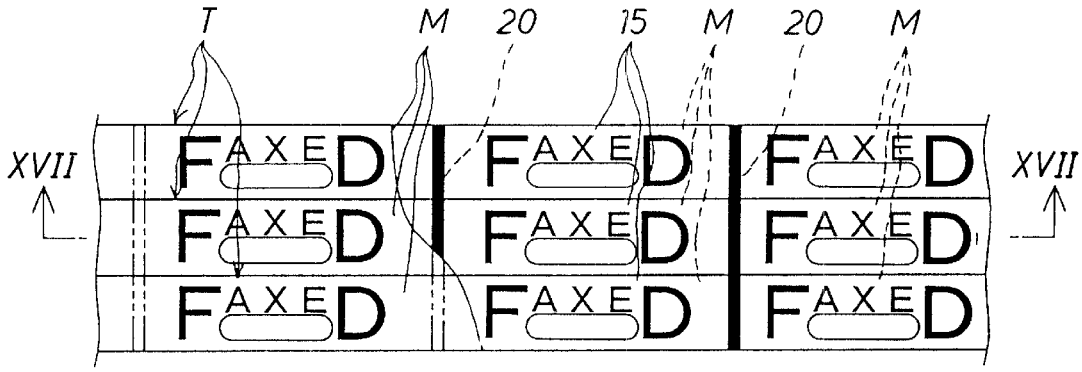
FIG. 17A is a plan of mark transfer tool of a mark transfer tool according to embodiment 10 of the invention, showing a partially cut-away view of the mark transfer tape in the manufacturing process.
Figure 17B:
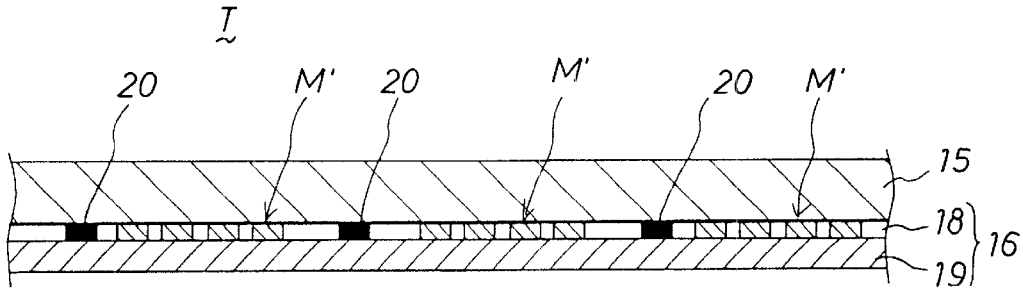
FIG. 17B is a sectional view along line XVII—XVII in FIG. 17A of the mark transfer tape.
Figure 17C:
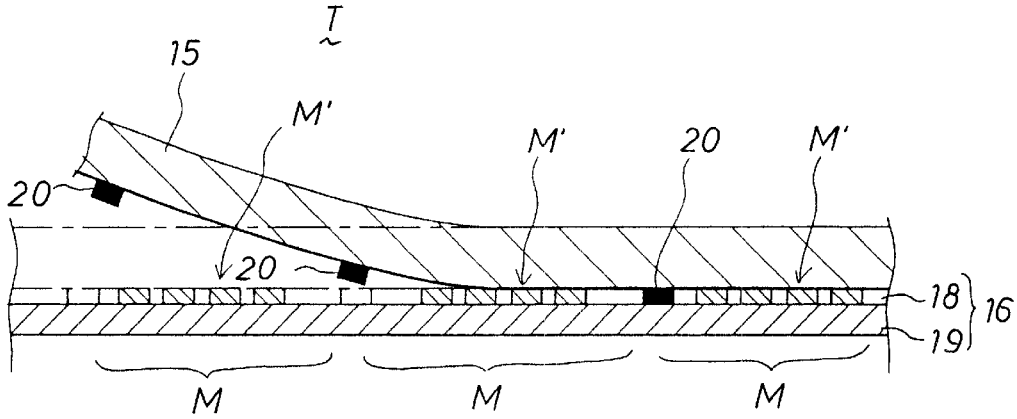
FIG. 17C is a sectional view showing a peeling state of base tape and transfer mark layer of the mark transfer tape.

This embodiment is shown in FIGS. 17A–17C, in which the structure of the mark transfer tape T is modified.

That is, in the mark transfer tape T of this embodiment, as shown in FIGS. 17A–17C, a transfer mark layer 16 to be adhered and held on the surface side (lower side in FIG. 17B and FIG. 17C) of a base tape 15 is an integral laminate structure consisting of a mark array layer 18 and a pressure-sensitive adhesive layer 19, and the mark forming layer 17 in the mark transfer tape T in embodiment 1 is omitted.

In other words, the mark array layer 18 is directly printed and formed on the parting treated surface of the base tape 15, and when transferring a mark, therefore, the mark array layer 18 is peeled from the surface of the base tape 15, and the surface layer is formed directly.

The other configuration and operation are same as in embodiment 1.

Embodiment 11

Figure 18A:
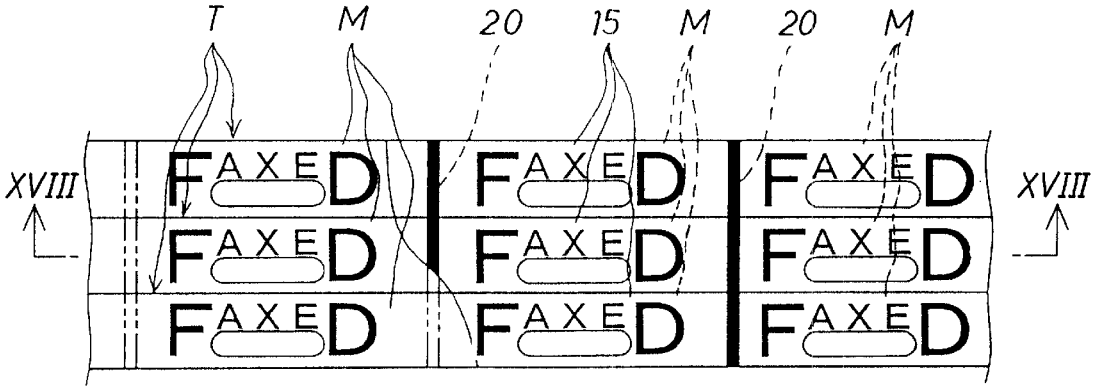
FIG. 18A is a plan of mark transfer tool of a mark transfer tool according to embodiment 11 of the invention, showing a partially cut-away view of the mark transfer tape in the manufacturing process.
Figure 18B:
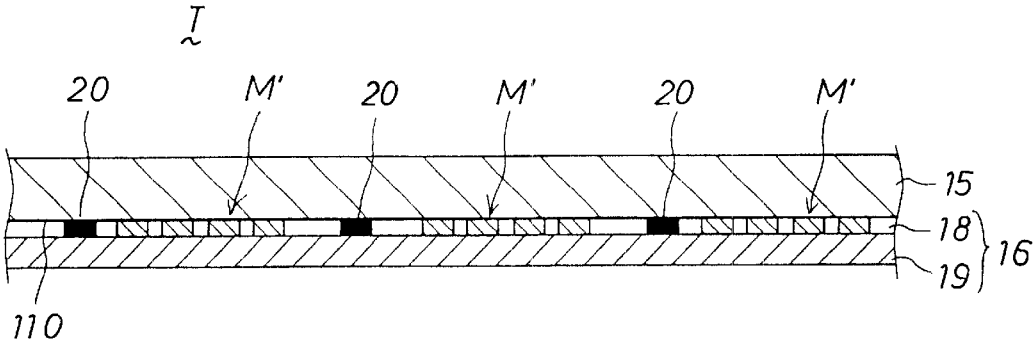
FIG. 18B is a sectional view along line XVIII—XVIII in FIG. 18A of the mark transfer tape.
Figure 18C:
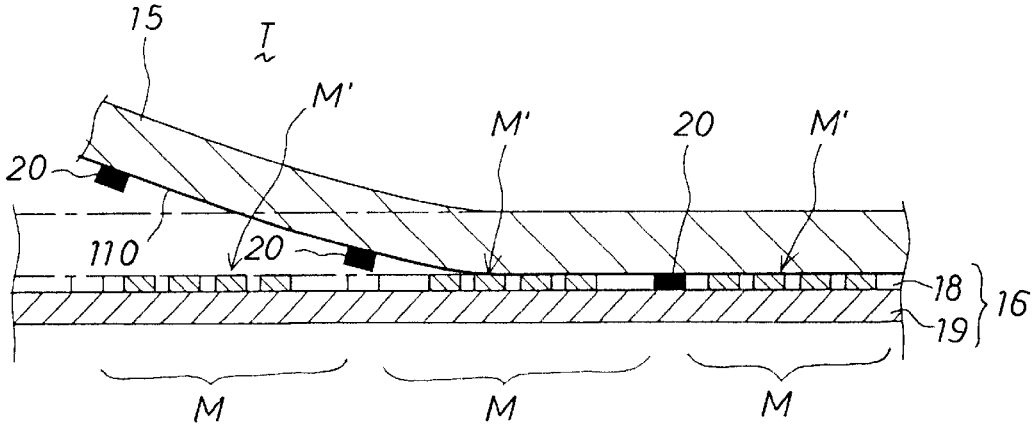
FIG. 18C is a sectional view showing a peeling state of base tape and transfer mark layer of the mark transfer tape.

This embodiment is shown in FIGS. 18A–18C, in which the structure of the mark transfer tape T in embodiment 10 is slightly modified.

That is, in the mark transfer tape T of this embodiment, as shown in FIGS. 18A–18C, the surface side (lower side in FIG. 18B and FIG. 18C) of a base tape 15 is treated to be adhesive 110, and a mark array layer 18 is directly printed and formed on this surface. When transferring a mark, therefore, the mark array layer 18 is peeled from the surface of the base tape 15, and the surface layer is formed directly.

The other configuration and operation are same as in embodiment 10.

Embodiment 12

Figure 19A:
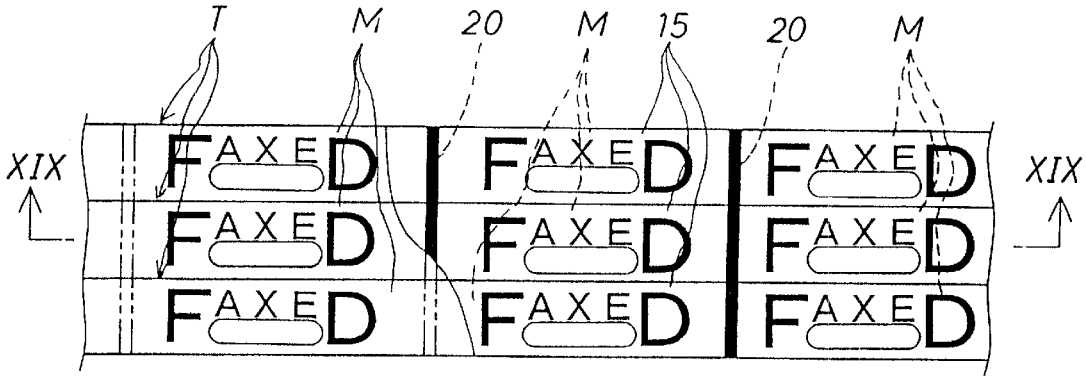
FIG. 19A is a plan of mark transfer tool of a mark transfer tool according to embodiment 12 of the invention, showing a partially cut-away view of the mark transfer tape in the manufacturing process.
Figure 19B:
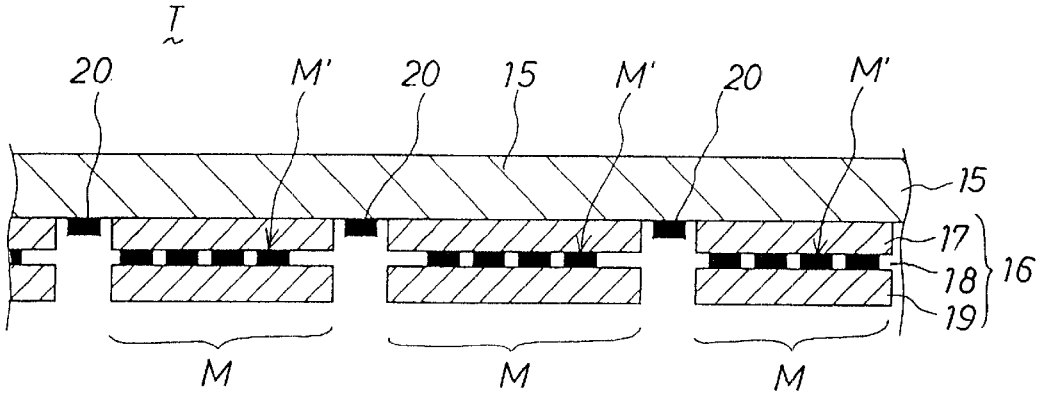
FIG. 19B is a sectional view along line XIX—XIX in FIG. 19A of the mark transfer tape.
Figure 19C:
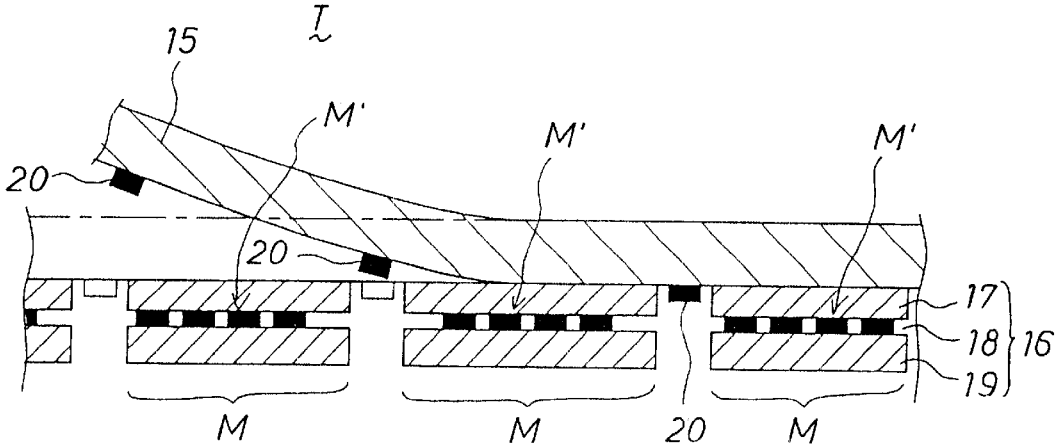
FIG. 19C is a sectional view showing a peeling state of base tape and transfer mark layer of the mark transfer tape.

This embodiment is shown in FIGS. 19A–19C, in which the structure of the mark transfer tape T in embodiment 1 is modified.

That is, in the mark transfer tape T in embodiment 1, as mentioned above, the transfer mark layer 16 is formed continuously over the entire length of the base tape 15, but in the mark transfer tape T of the embodiment, as shown in FIGS. 19A–19C, transfer marks M, M, . . . for composing the transfer mark layer 16 are peelably disposed consecutively at specified intervals independently on the surface of the base tape 15.

The visual recognition line 20 is disposed between the transfer marks M, M in the transfer mark layer 16.

In this configuration, same as the transfer operation explained in embodiment 1, with the visual recognition line 20 visually coinciding with the visual recognition positioning part 21 of the transfer head H, the leading end pressing portion 25 of the transfer head H is tightly pressed to the transfer start end on the transfer area 50 of sheet of paper, and the case 2 is directly moved along the sheet of paper, and is stopped when the next visual recognition line 20 coincides with the visual recognition positioning part 21.

By this operation, only one transfer mark M of the mark transfer tape T is peeled securely from the base tape 15, and transferred onto the transfer area 50.

Embodiment 13

Figure 20A:
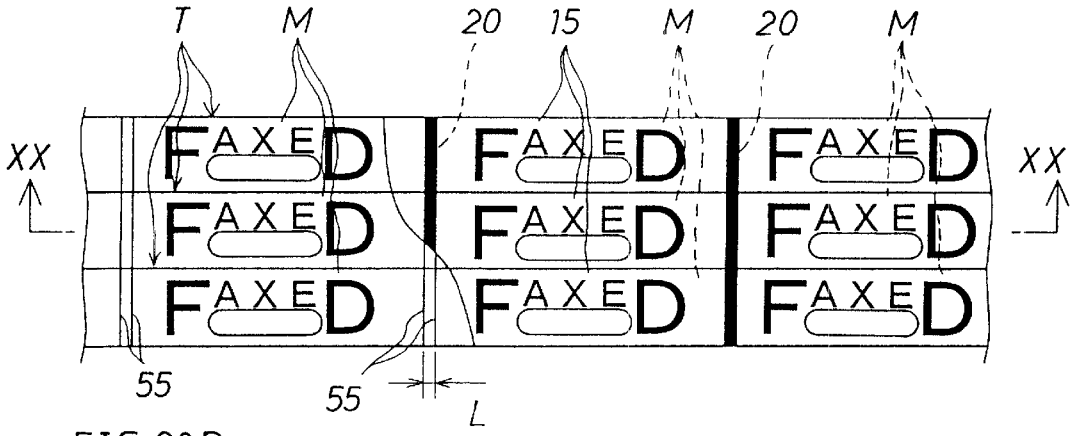
FIG. 20A is a plan of mark transfer tool of a mark transfer tool according to embodiment 13 of the invention, showing a partially cut-away view of the mark transfer tape in the manufacturing process.
Figure 20B:
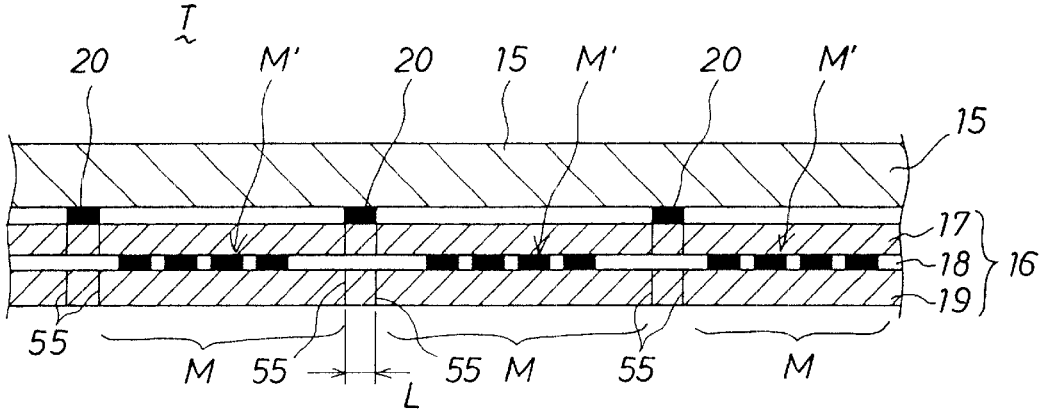
FIG. 20B is a sectional view along line XX—XX in FIG. 20A of the mark transfer tape.
Figure 20C:
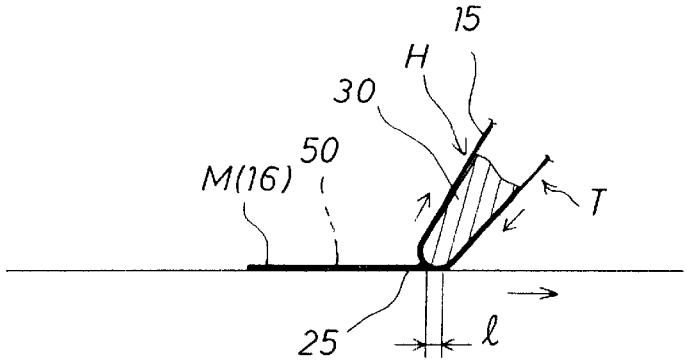
FIG. 20C is a sectional view showing the pressing width of leading end pressing portion of the transfer head of the mark transfer tool in relation to the mark transfer tape.

This embodiment is shown in FIGS. 20A–20C in which the structure of the mark transfer tape T in embodiment 1 is modified.

That is, in the mark transfer tape T of the embodiment, same as the mark transfer tape T in embodiment 1, the transfer mark layer 16 is formed continuously over the entire length of the base tape 15, but as shown in FIGS. 20A–20C, at least two cut-off sections 55, 55 are provided at specific interval between the transfer marks M, M of the transfer mark layer 16, and the transfer mark M can be cut off more easily and securely when transferring.

In the shown embodiment, the two cut-off sections 55, 55 are provided in the central position of the transfer marks M, M at a specific interval. These cut-off sections 55, 55 are extended and formed vertically and straightly in the longitudinal direction of the transfer tape T in the overall width of the transfer mark layer 16. The interval L of the cut-off sections 55, 55 is set larger than the pressing width I (see FIG. 20C) of the leading end pressing portion 25 of the transfer head H (L>I).

In such configuration, same as in the transfer operation explained in embodiment 1, in the previous mark transfer operation completion state (when the visual recognition line 20 coincides visually with the visual recognition positioning part 21), the transfer head H is tightly pressed to the transfer start end on the transfer area 50, and the case 2 is directly moved along the sheet of paper, and is stopped when the next visual recognition line 20 coincides with the visual recognition positioning part 21, and the transfer head H is lifted from the transfer area 50 and separated. In this case, at the stopping position of the mark transfer tool 1, the leading end pressing portion 25 of the transfer head H is between the two cut-off sections 55, 55.

By this operation, only one transfer mark M of the mark transfer tape T is peeled securely from the base tape 15 at the position of cut-off section 55, and transferred onto the transfer area 50, and the cut-off line is straight.

The other configuration and operation are same as in embodiment 1.

Embodiment 14

Figure 21A:
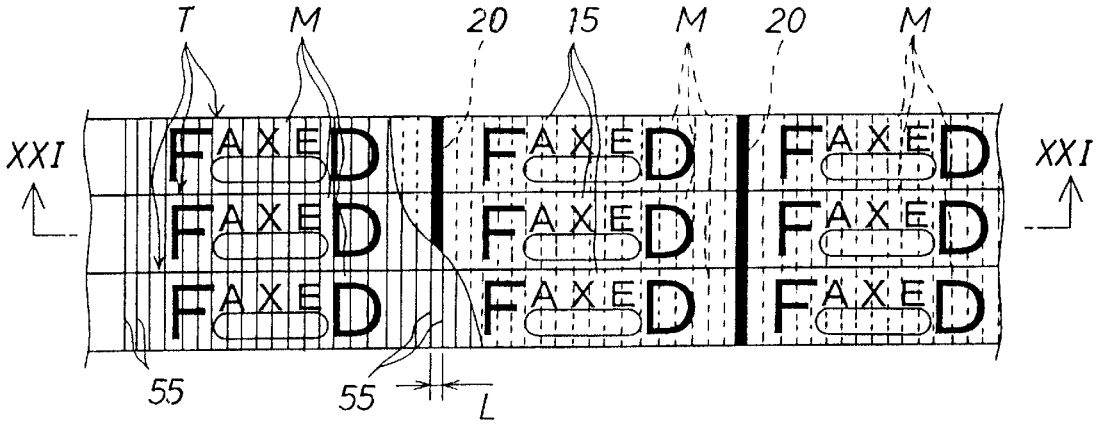
FIG. 21A is a plan of mark transfer tool of a mark transfer tool according to embodiment 14 of the invention, showing a partially cut-away view of the mark transfer tape in the manufacturing process.
Figure 21B:
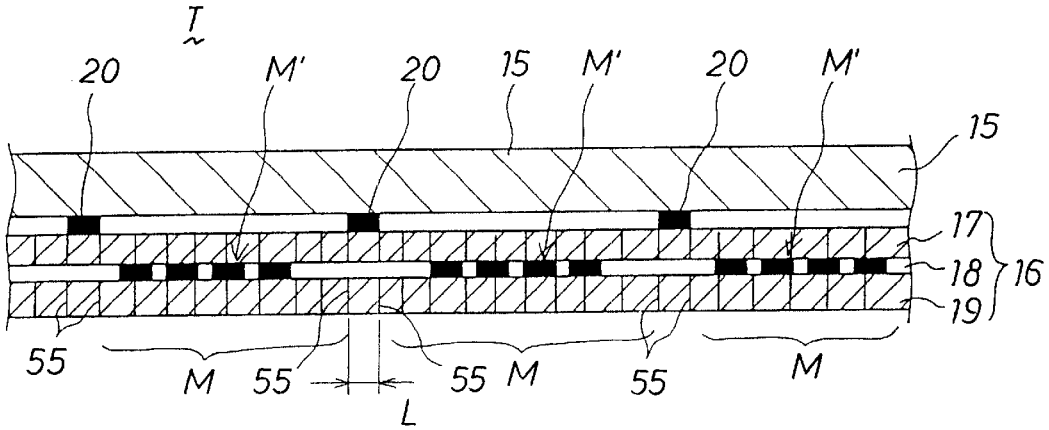
FIG. 21B is a sectional view along line XXI—XXI in FIG. 21A of the mark transfer tape.
Figure 21C:
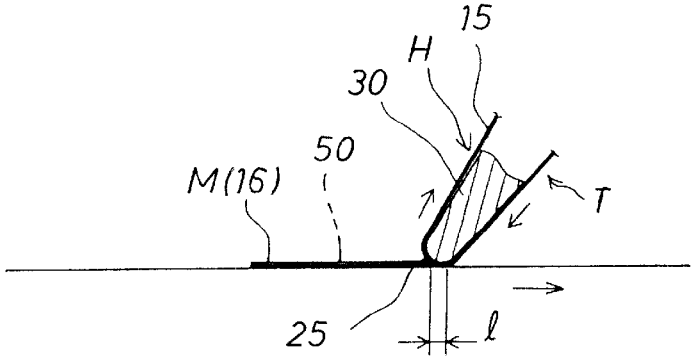
FIG. 21C is a sectional view showing the pressing width of leading end pressing portion of the transfer head of the mark transfer tool in relation to the mark transfer tape.

This embodiment is shown in FIGS. 21A–21C, in which the structure of the mark transfer tape T in embodiment 13 is modified.

That is, in the mark transfer tape T of embodiment 13, two cut-off sections 55, 55 are provided at specific interval only between the transfer marks M, M of the transfer mark layer 16, but in the mark transfer tape T of the embodiment, multiple cut-off sections 55, 55, . . . are provided at specific interval in the transfer mark layer 16 over the entire length of the transfer mark layer 16.

In such configuration, in the manufacturing process of the mark transfer tape T, the cut-off sections 55, 55, . . . can be formed easily and securely as compared with the case of embodiment 13.

In transfer operation, it is the same as in embodiment 13 that only one transfer mark M on the mark transfer tape T is transferred on the correction area 50, with the cut-off line being straight, but in this case the stopping position condition of the mark transfer tool 1 is less strict than in embodiment 13, and by lifting the mark transfer tool 1 when the visual recognition line 20 nearly coincides with the visual recognition positioning part 21 visually, the transfer mark M is securely peeled off from the base tape 15 at the position of cut-off section 55, and is transferred on the transfer area 50, so that the transfer mark M is cut off more easily and securely when transferring.

The other configuration and operation are same as in embodiment 13.

The foregoing embodiments are only preferred embodiments for carrying out the invention, and the invention is not limited by them, but can be changed and modified in various forms within its scope.

For example, in these embodiments, as visual recognition positioning parts visually coinciding with the division visual recognition means 20, 61, 80 of the mark transfer tape T, the leading end edge 25 (21) of the transfer head H and the positioning index 90 provided on the surface of the transfer head H are used, but not limited to them, other positions may be also employed as far as the traveling mark transfer tape T is visually recognizable at stationary side. For example, the leading end edge 120 of protruding position of the transfer head H in the case 2 (see FIG. 1 to FIG. 3) may be also usable.

The specific structure of the mark transfer tool 1 may be also realized in other designs. For example, the transfer head H in the shown embodiments is of so-called rotary head structure in which the head main body 30 is rotatably held about its axial center, and it is allowed to use in various tape pressing and transferring positions as shown in FIGS. 7A to 7C, but it may be also realized in a fixed head structure so as to be usable only in a specific one of these tape pressing and transferring positions.

As described herein, the mark transfer tool of the invention comprises a hand-held case, a pay-out reel containing a mark transfer tape, being rotatably installed in the case, a rotatable take-up reel for collecting the used mark transfer tape, being rotatably installed in the case, and a transfer head for pressing and transferring the mark transfer tape being paid out from the pay-out reel onto the transfer area, being disposed at the leading end of the case, in which the mark transfer tape has pressure-sensitive adhesive transfer marks disposed and held continuously at specific intervals peelably on the surface of a base tape, the transfer mark is composed of various marks and overwriting blank spaces, the division visual recognition means for indicating the division position of transfer marks is provided between transfer marks, visual recognition positioning part visually coinciding with the division visual recognition means of the mark transfer tape is provided at a visually recognizable position of the tape traveling part of the transfer head, and therefore various marks composed of characters, codes, patterns or their combination can be transferred by a completely new mark transfer technology different from the conventional mark transfer technology such as stamp impression or mark seal adhesion, so that diversified preferences of general users can be effectively satisfied.

That is, when transferring a transfer mark on the mark transfer tape on a desired transfer area of a sheet of paper or the like by using the mark transfer tool of the invention, the case is gripped by fingers, and the leading end pressing portion of the transfer head is tightly pressed to the transfer area, and is moved along the sheet of paper, so that the transfer mark is transferred.

In this case, with the division visual recognition means provided in the mark transfer tape visually coinciding with the visual recognition positioning part of the transfer head, the transfer head is tightly pressed to the transfer start end on the transfer area, and the case is directly moved along the sheet of paper, and is stopped when the next division visual recognition means coincides with the visual recognition positioning part, so that the transfer mark of the mark transfer tape in the leading end pressing portion of the transfer head can be accurately transferred on the transfer area.

Further, since the transfer mark is composed of the mark and overwriting blank space, after transfer of transfer mark, desired characters may be written over by a writing tool on the overwriting blank space.

Since such overwriting blank area is provided in the transfer mark, it is possible to write in a position of a material not to be written directly by writing tool or a material not to be erased cleanly if once written.

Exemplary embodiments presented in the detailed description of the invention above are intended to disclose the technical features of the invention, and it is to be understood that the invention is not limited to those illustrated embodiments alone but is interpreted in a wider sense of meaning, and that various changes and modifications may be effected without departing from the scope or true spirit of the invention.

What is claimed is:

1. A mark transfer tool for transferring a transfer mark on a mark transfer tape on a sheet of paper or the like, comprising:

a hand-held case, a pay-out reel containing a mark transfer tape, being rotatably installed in the case, a rotatable take-up reel for collecting the used mark transfer tape, being rotatably installed in the case, and a transfer head for pressing and transferring the mark transfer tape being paid out from the pay-out reel onto the transfer area, being disposed at the leading end of the case, wherein said mark transfer tape has pressure-sensitive adhesive transfer marks disposed and held continuously at specific intervals peelably on the surface of a base tape, said transfer mark being composed of a mark and an overwriting blank space, and division visual recognition means showing division positions of transfer marks is disposed between transfer marks, and visual recognition positioning parts visually corresponding and coinciding with the division visual recognition means of the mark transfer tape are disposed at visually recognizable positions at the stationary side of the traveling mark transfer tape.

2. The mark transfer tool of claim 1, wherein at least the surface forming portion of the overwriting blank space of the transfer mark is made of a material to be written over by a writing tool.

3. The mark transfer tool of claim 1, wherein a transfer mark layer composed of multiple transfer marks is peelably adhered and held at the surface side of the base tape of which back side is treated to be parted.

4. The mark transfer tool of claim 1, wherein a transfer mark layer composed of multiple transfer marks is peelably and separably adhered and held at the surface side of the base tape of which back side is treated to be parted.

5. The mark transfer tool of claim 4, wherein at least two cut-off sections are provided at specific interval between transfer marks of the transfer mark layer, and these cut-off sections are extended and formed straightly over the entire width of the transfer mark layer.

6. The mark transfer tool of claim 4, wherein multiple cut-off sections are provided at specific interval in the entire length of the transfer mark layer, and these cut-off sections are extended and formed straightly over the entire width of the transfer mark layer.

7. The mark transfer tool of claim 5 or 6, wherein the disposing interval of the cut-off sections is set larger than the pressing width of the leading end pressing portion of the transfer head for pressing and transferring the transfer head.

8. The mark transfer tool of claim 1, wherein said visual recognition positioning parts are disposed at visually recognizable positions of the tape running area of the transfer head.

9. The mark transfer tool of claim 8, wherein said visual recognition positioning parts are disposed at leading edges of the transfer head.

10. The mark transfer tool of claim 8, wherein said visual recognition positioning parts are positioning indices provided on the surface of the transfer head.

11. The mark transfer tool of claim 1, wherein said visual recognition positioning parts are disposed at visually recognizable positions in the leading end portion of the case.

12. The mark transfer tool of claim 11, wherein said visual recognition positioning parts are disposed at leading edges of protrusion positions of the transfer head in the case.

13. The mark transfer tool of any one of claims 1 to 6 and 8 to 12, wherein said division visual recognition means is a line for visual recognition extending straightly in the width direction of the base tape formed between mutually adjacent transfer marks in the base tape, and is composed to indicate the transfer completion position of one transfer mark when the visual recognition line corresponds and coincides with the visual recognition position part in the mark transfer operation.

14. The mark transfer tool of any one of claims 1 to 6 and 8 to 12, wherein said division visual recognition means is a mark indication line for indicating the transfer length range of each transfer mark provided at least at one edge in the width direction of the base tape, and the boundary between mutually adjacent mark indication lines is the division visual recognition part, and is composed to indicate the transfer completion position of one transfer mark when the visual recognition line corresponds and coincides with the visual recognition position part in the mark transfer operation.

15. The mark transfer tool of any one of claims 1 to 6 and 8 to 12, wherein said division visual recognition means is a notch for visual recognition penetrating through mutually adjacent transfer marks in the base tape, and is composed to indicate the transfer completion position of one transfer mark when the visual recognition notch corresponds and coincides with the visual recognition position part in the mark transfer operation.

16. The mark transfer tool of claims 1 to 6 and 8 to 12, wherein said notch for visual recognition is an arc-shaped notch formed at least at one end in the width direction of the base tape.

17. The mark transfer tool of claims 1 to 6 and 8 to 12, wherein said notch for visual recognition is a circular notch formed in the middle in the width direction of the base tape.

18. The mark transfer tool of any one of claims 1 to 6 and 8 to 12, wherein a division allowable visual recognition part is provided at least at the upstream side or downstream side in the tape running direction of said division visual recognition means, and it is composed to indicate the allowable limit of the transfer completion position or transfer start position of one transfer mark when the division allowable visual recognition part corresponds and coincides with the visual recognition position part in the mark transfer operation.

19. The mark transfer tool of any one of claims 1 to 6 and 8 to 12, wherein a tape cartridge comprising at least the pay-out reel and take-up reel is of refill type being detachably disposed in the case and having a structure so that the mark transfer tape may be exchanged.

20. The mark transfer tool of any one of claims 1 to 6 and 8 to 12, wherein it is of one time type having the pay-out reel and take-up reel disposed in the case, with the transfer head provided at the leading end of the case.

21. A mark transfer tape disposed and used in a mark transfer tool for transferring a transfer mark on a sheet of paper, wherein pressure-sensitive adhesive transfer marks are disposed and held continuously at specific intervals peelably on the surface of a base tape, said transfer mark being composed of a mark and an overwriting blank space, and division visual recognition means showing division positions of transfer marks is disposed between transfer marks, and the division visual recognition means is configured to indicate the division position of one transfer mark when visually corresponding and coinciding with the visual recognition positioning part provided on the transfer head of the mark transfer tool in the mark transfer operation of the mark transfer tool.

22. The mark transfer tool of claim 21, wherein at least the surface forming portion of the overwriting blank space of the transfer mark is made of a material to be written over by a writing tool.

23. The mark transfer tool of claim 21, wherein a transfer mark layer composed of multiple transfer marks is peelably adhered and held at the surface side of the base tape of which back side is treated to be parted.

24. The mark transfer tool of claim 21, wherein a transfer mark layer composed of multiple transfer marks is peelably and separably adhered and held at the surface side of the base tape of which backside is treated to be parted.

25. The mark transfer tool of claim 24, wherein at least two cut-off sections are provided at specific interval between transfer marks of the transfer mark layer, and these cut-off sections are extended and formed straightly over the entire width of the transfer mark layer.

26. The mark transfer tool of claim 24, wherein multiple cut-off sections are provided at specific interval in the entire length of the transfer mark layer, and these cut-off sections are extended and formed straightly over the entire width of the transfer mark layer.

27. The mark transfer tool of claim 25 or 26, wherein the disposing interval of the cut-off sections is set larger than the pressing width of the leading end pressing portion of the transfer head for pressing and transferring the transfer head.

28. The mark transfer tool of claim 23 or 24, wherein the surface forming portion of the transfer mark is made of a material to be written over by a writing tool.

29. The mark transfer tape of claim 23 or 24, wherein said transfer mark layer is composed by integrally laminating a pressure-sensitive adhesive layer composed of a pressure-sensitive adhesive transparent material, and a mark array layer composed of multiple marks arranged continuously at specific intervals in the running direction of the base tape, and this transfer mark layer is adhered and held to the surface of the base tape treated for parting, peelably and separably in pieces through the pressure-sensitive adhesive layer.

30. The mark transfer tape of claim 23 or 24, wherein said transfer mark layer is composed by integrally laminating a mark forming layer composed of an adhesive transparent material, a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape treated for parting, peelably and separably in pieces through the mark forming layer.

31. The mark transfer tape of claim 23 or 24, wherein said transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape treated for parting, peelably and separably in pieces through the mark array layer.

32. The mark transfer tape of claim 23 or 24, wherein said transfer mark layer is composed by integrally laminating a mark array layer composed of multiple marks arranged continuously at specific intervals in the running direction of the base tape, and a pressure-sensitive adhesive layer composed of a pressure-sensitive adhesive transparent material, and this transfer mark layer is adhered and held to the surface of the base tape processed to be adhesive, peelably and separably in pieces through the mark array layer.

33. The mark transfer tape of claim 29, wherein said division visual recognition means is a line for visual recognition formed correspondingly between mutually adjacent transfer marks on the surface of the base tape, and is composed to indicate the transfer completion position of one transfer mark when the visual recognition line corresponds and coincides with the visual recognition position part in the mark transfer operation of the mark transfer tool.

34. The mark transfer tape of claim 29, wherein said division visual recognition means is composed of a mark indication formed at least at one edge in the width direction on the surface of the base tape, and a division visual recognition part as the boundary between mutually adjacent mark indication lines, and the mark indication line is disposed corresponding to the transfer length range of the transfer mark, and is composed to indicate the transfer completion position of one transfer mark when the visual recognition line corresponds and coincides with the visual recognition position part in the mark transfer operation of the mark transfer tool.

35. The mark transfer tape of any one of claims 21 to 26, wherein said base tape is made of a see-through transparent film material, and the division visual recognition means is a line for visual recognition formed correspondingly between mutually adjacent transfer marks on the back side of the base tape, and is composed to indicate the transfer completion position of one transfer mark when the visual recognition line corresponds and coincides with the visual recognition position part in the mark transfer operation of the mark transfer tool.

36. The mark transfer tape of any one of claims 21 to 26, wherein said base tape is made of a see-through transparent film material, and the division visual recognition means is composed of a mark indication formed at least at one edge in the width direction on the back side of the base tape, and a division visual recognition part as the boundary between mutually adjacent mark indication lines, and the mark indication line is disposed corresponding to the transfer length range of the transfer mark, and is composed to indicate the transfer completion position of one transfer mark when the division visual recognition part corresponds and coincides with the visual recognition position part in the mark transfer operation of the mark transfer tool.

37. The mark transfer tape of any one of claims 21 to 26, wherein said division visual recognition means is a notch for visual recognition penetrating through mutually adjacent transfer marks at least in the base tape, and is composed to indicate the transfer completion position of one transfer mark when the visual recognition notch corresponds and coincides with the visual recognition position part in the mark transfer operation of the mark transfer tool.

38. The mark transfer tape of claim 37, wherein said notch for visual recognition is an arc-shaped notch formed at least at one end in the width direction of the base tape.

39. The mark transfer tape of claim 37, wherein said notch for visual recognition is a circular small hole formed in the middle in the width direction of the base tape.

40. The mark transfer tape of any one of claims 21 to 26, wherein a division allowable visual recognition part is provided at least at the upstream side or downstream side in the tape running direction of said division visual recognition means, and it is composed to indicate the allowable limit of the transfer completion position or transfer start position of one transfer mark when the division allowable visual recognition part corresponds and coincides with the visual recognition position part in the mark transfer operation.

* * * * *